US008806905B2

(12) United States Patent
Burmesch et al.

(10) Patent No.: US 8,806,905 B2
(45) Date of Patent: Aug. 19, 2014

(54) PADLOCK ASSEMBLY

(71) Applicant: Master Lock Company LLC, Oak Creek, WI (US)

(72) Inventors: Gary R. Burmesch, Port Washington, WI (US); Elliot Gronland, Milwaukee, WI (US)

(73) Assignee: Master Lock Company LLC, Oak Creek, WI (US)

( * ) Notice: Subject to any disclaimer, the term of this patent is extended or adjusted under 35 U.S.C. 154(b) by 0 days.

(21) Appl. No.: 13/832,615

(22) Filed: Mar. 15, 2013

(65) Prior Publication Data

US 2013/0276487 A1 Oct. 24, 2013

Related U.S. Application Data

(60) Provisional application No. 61/635,536, filed on Apr. 19, 2012.

(51) Int. Cl.
*E05B 67/24* (2006.01)

(52) U.S. Cl.
USPC ..... 70/38 A; 70/39; 70/51; 70/52; 70/53; 70/371

(58) Field of Classification Search
CPC ..... E05B 37/025; E05B 37/10; E05B 67/063; E05B 67/003; E05B 37/02; E05B 67/22; E05B 67/24; E05B 67/26; E05B 37/14; E05B 9/084; E05B 67/00; E05B 67/06
USPC ..... 70/26, 371, 51–53, 38 R, 38 A, 38 B, 70/38 C, 39, 25
See application file for complete search history.

(56) References Cited

U.S. PATENT DOCUMENTS

| | | | | | |
|---|---|---|---|---|---|
| 53,096 | A | | 3/1866 | Ascherfeld | |
| 396,596 | A | | 1/1889 | Peterson | |
| 807,877 | A | | 12/1905 | Soley | |
| 1,579,632 | A | * | 4/1926 | Best | 70/38 A |
| 1,660,903 | A | * | 2/1928 | Adamson | 70/38 A |
| 1,844,569 | A | * | 2/1932 | Fairchild | 70/38 C |
| 1,849,070 | A | * | 3/1932 | Buehner | 70/38 C |

(Continued)

OTHER PUBLICATIONS

International Search Report and Written Opinion from International Application No. PCT/US/2013/036985, dated Jul. 19, 2013.

*Primary Examiner* — Lloyd Gall
(74) *Attorney, Agent, or Firm* — Calfee, Halter & Griswold LLP

(57) ABSTRACT

A padlock includes a lock body, a shackle assembled with the lock body, a lock subassembly disposed in a cavity in the lock body, and a shackle retainer assembled with the lock body. The lock subassembly is operable between a locked position securing the shackle in a closed position and an unlocked position permitting movement of the shackle to an open position. The shackle retainer extends into a first shackle bore and is received in a recess in a first leg of the shackle. When the shackle is in the open position, the lock subassembly is manipulable to be moved from a first position to a second position to generate a space in the cavity aligned with the shackle retainer, such that the shackle retainer is extendable into the space for disengagement of the shackle retainer from the first shackle leg recess.

21 Claims, 20 Drawing Sheets

(56) References Cited

U.S. PATENT DOCUMENTS

| | | | | | |
|---|---|---|---|---|---|
| 1,942,328 | A | | 1/1934 | Fraim | |
| 1,993,408 | A | * | 3/1935 | Ledin | 70/38 B |
| 2,039,244 | A | * | 4/1936 | Lowe | 70/368 |
| 2,094,604 | A | * | 10/1937 | Keil | 70/38 A |
| 2,141,748 | A | * | 12/1938 | Hansen | 70/38 A |
| 2,199,336 | A | | 4/1940 | Fletcher | |
| 2,691,288 | A | * | 10/1954 | Childs | 70/38 A |
| 2,865,193 | A | * | 12/1958 | McConnell | 70/38 B |
| 4,138,868 | A | * | 2/1979 | Richards, Sr. | 70/38 A |
| 4,241,594 | A | | 12/1980 | Miller et al. | |
| 4,404,825 | A | * | 9/1983 | Dixon et al. | 70/368 |
| 4,576,022 | A | | 3/1986 | Gamble | |
| 5,186,029 | A | | 2/1993 | Myers | |
| 5,400,625 | A | | 3/1995 | Embry | |
| 5,406,812 | A | | 4/1995 | Jaw | |
| 5,417,092 | A | | 5/1995 | Iu | |
| 5,896,761 | A | * | 4/1999 | Chen | 70/38 A |
| 6,101,852 | A | * | 8/2000 | Steinbach | 70/38 A |
| 6,393,876 | B1 | * | 5/2002 | Matyko | 70/38 A |
| 6,705,134 | B2 | | 3/2004 | Miranda | |
| 6,708,533 | B2 | | 3/2004 | Lavikainen et al. | |
| 6,708,534 | B1 | | 3/2004 | Ruan | |
| 6,769,277 | B1 | | 8/2004 | Chang | |
| 7,021,092 | B2 | | 4/2006 | Loughlin | |
| 7,382,250 | B2 | | 6/2008 | Marcelle et al. | |
| 7,581,423 | B2 | * | 9/2009 | Brojanac et al. | 70/455 |
| 8,234,896 | B2 | * | 8/2012 | Uliano | 70/371 |
| 2002/0194887 | A1 | | 12/2002 | Chang | |
| 2003/0070453 | A1 | * | 4/2003 | Gast et al. | 70/38 A |
| 2003/0121295 | A1 | * | 7/2003 | Lavikainen et al. | 70/38 A |
| 2003/0159479 | A1 | * | 8/2003 | Kajuch et al. | 70/379 R |
| 2003/0196461 | A1 | * | 10/2003 | Liou | 70/38 A |
| 2004/0194516 | A1 | | 10/2004 | Chen | |
| 2005/0210932 | A1 | * | 9/2005 | Azzalin et al. | 70/51 |
| 2005/0235709 | A1 | * | 10/2005 | Meckbach | 70/38 A |
| 2006/0185404 | A1 | * | 8/2006 | Hansen | 70/38 A |
| 2006/0260369 | A1 | | 11/2006 | Lai et al. | |

* cited by examiner

PADLOCK ASSEMBLY

CROSS-REFERENCE TO RELATED APPLICATION

This application claims priority to and the benefit of U.S. Provisional Patent Application Ser. No. 61/635,536, entitled "PADLOCK WITH MULTIPLE PIECE BODY" and filed Apr. 19, 2012, the entire disclosure of which is incorporated herein by reference.

BACKGROUND

Padlocks are used in a variety of applications, including, for example, with enclosures such as lockers, storage sheds, and various gates and doors. A typical padlock includes a generally rectangular lock body having a generally U-shaped shackle extending from one end and a keyway disposed on an opposite end. When a proper key is inserted in the keyway, a key cylinder within the lock body may be rotated to disengage a locking mechanism from the shackle, allowing the shackle to slide out of the lock body until a short leg of the shackle is fully removed or separated from the lock body, allowing removal of the lock from a hasp or other such portion of an enclosure to be locked.

SUMMARY

In an exemplary embodiment of the present application, a padlock includes a lock body, a shackle assembled with the lock body, a lock subassembly disposed in a cavity in the lock body, and a shackle retainer assembled with the lock body. The lock subassembly is operable between a locked position securing the shackle in a closed position and an unlocked position permitting movement of the shackle to an open position. The shackle retainer is accessible from an external surface of the lock body and extends into a first shackle bore and is received in a recess in a first leg of the shackle. When the shackle is in the open position, the lock subassembly is manipulable to be moved from a first position to a second position to generate a space in the cavity aligned with the shackle retainer, such that the shackle retainer is extendable into the space for disengagement of the shackle retainer from the first shackle leg recess.

Another exemplary embodiment of the present application involves a method of removing a shackle from a lock body of a padlock. In the exemplary method, a shackle is moved within a first shackle bore of the lock body to an open position. A lock subassembly disposed in a cavity in the lock body is moved from a first position to a second position to generate a space in the cavity in alignment with a shackle retainer at least partially disposed in the first shackle bore and within a recess in a first shackle leg disposed within the first shackle bore. A shackle retainer is accessed through an opening in the lock body and is moved into the cavity space, thereby disengaging the shackle retainer from the recess in the first shackle leg. The first shackle leg is withdrawn from the first shackle bore to remove the shackle from the lock body.

Still another exemplary embodiment of the present application involves a method of assembling a padlock. In the exemplary method, a lock body is provided, with the lock body defining first and second shackle bores and an internal cavity. A shackle retainer is positioned to extend through a cross-bore in the lock body and into the cavity. A long leg of a shackle is inserted into the first shackle bore to align a first end of a recess in the long shackle leg with the cross-bore. The shackle retainer is moved from the cavity further into the cross-bore and within the long shackle leg recess. A lock subassembly is inserted into the cavity and is secured to the lock body.

BRIEF DESCRIPTION OF THE DRAWINGS

Further features and advantages will become apparent from the following detailed description made with reference to the accompanying drawings, wherein.

DETAILED DESCRIPTION

This Detailed Description merely describes exemplary embodiments and is not intended to limit the scope of the claims in any way. Indeed, the invention as claimed is broader than and unlimited by the exemplary embodiments, and the terms used in the claims have their full ordinary meaning. For example, while the specific embodiments described herein relate to key operated padlocks, the features of the present application may additionally or alternatively be applied to other types of padlocks, including, for example, combination padlocks and electromechanically operated padlocks, and other types of portable locks, including, for example, cable locks, pin locks, and coupler locks.

Figure 1:
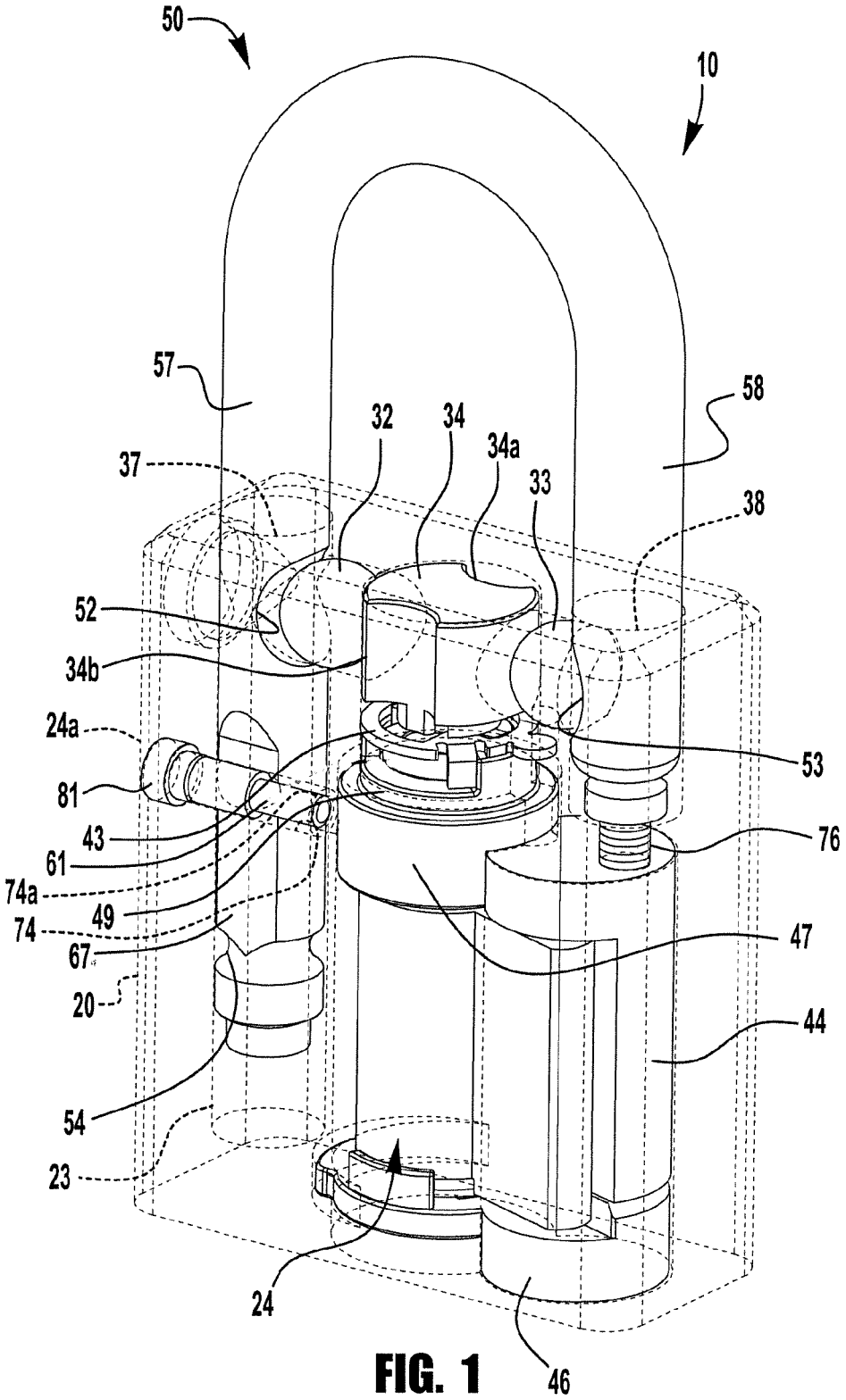
FIG. 1 is a perspective view of a padlock in accordance with an exemplary embodiment, shown in a locked condition with the lock body housings in phantom to illustrate additional features of the padlock.
Figure 2:
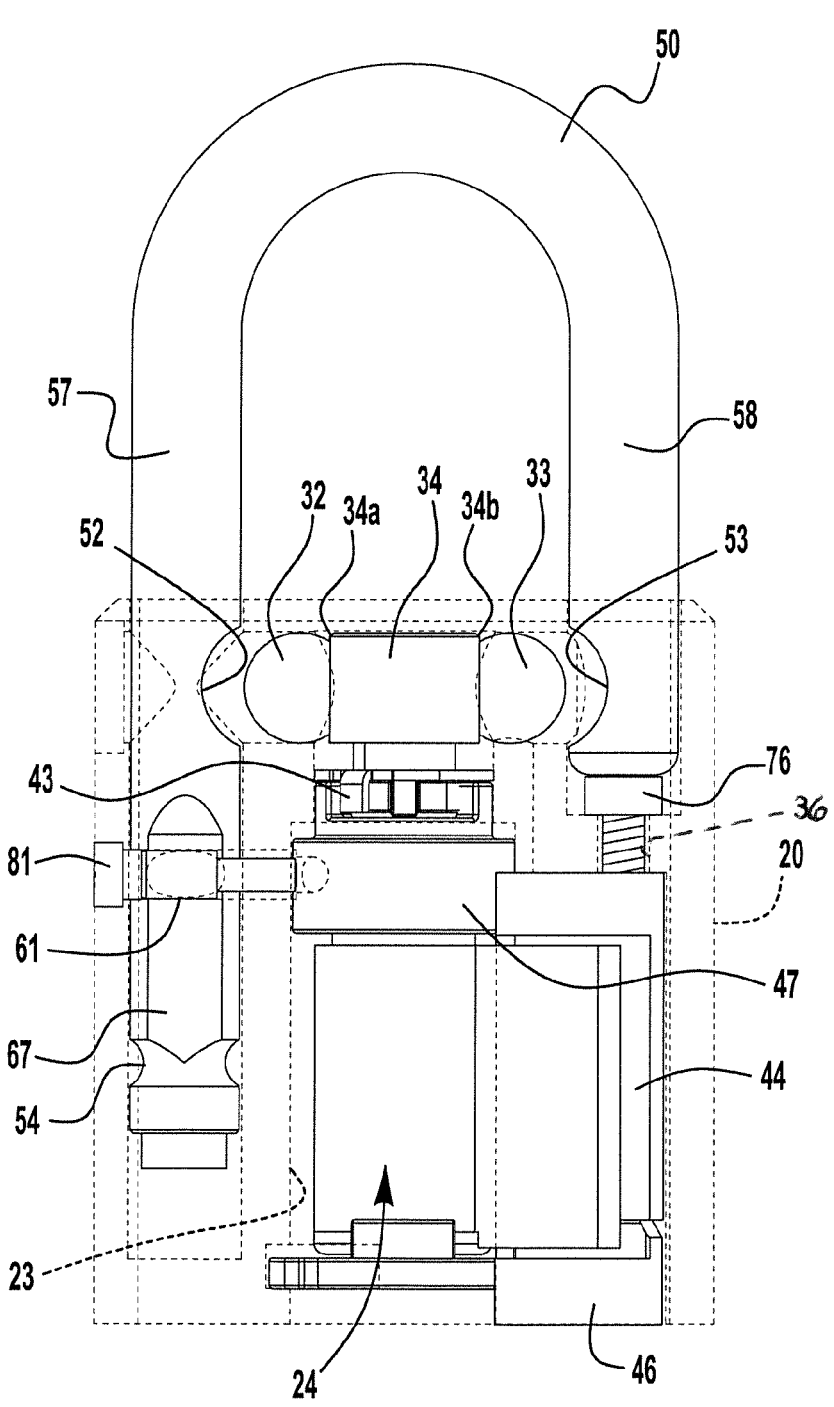
FIG. 2 is a front view of the padlock of FIG. 1, shown in an unlocked condition with the lock body housings in phantom to illustrate additional features of the padlock.
Figure 3:
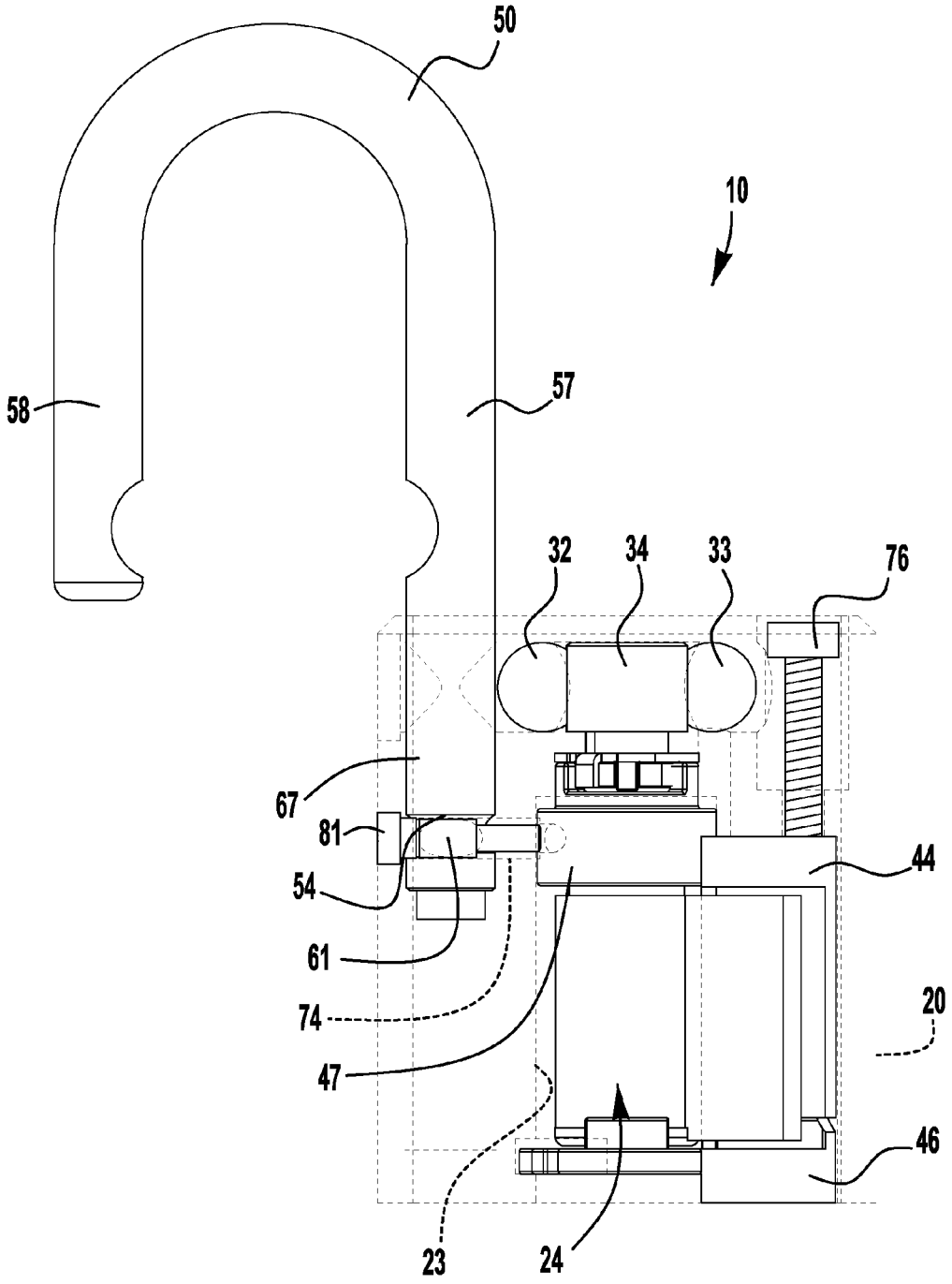
FIG. 3 is a front view of the padlock of FIG. 1, shown in an unlocked, shackle open condition with the lock body housings in phantom to illustrate additional features of the padlock.
Figure 4:
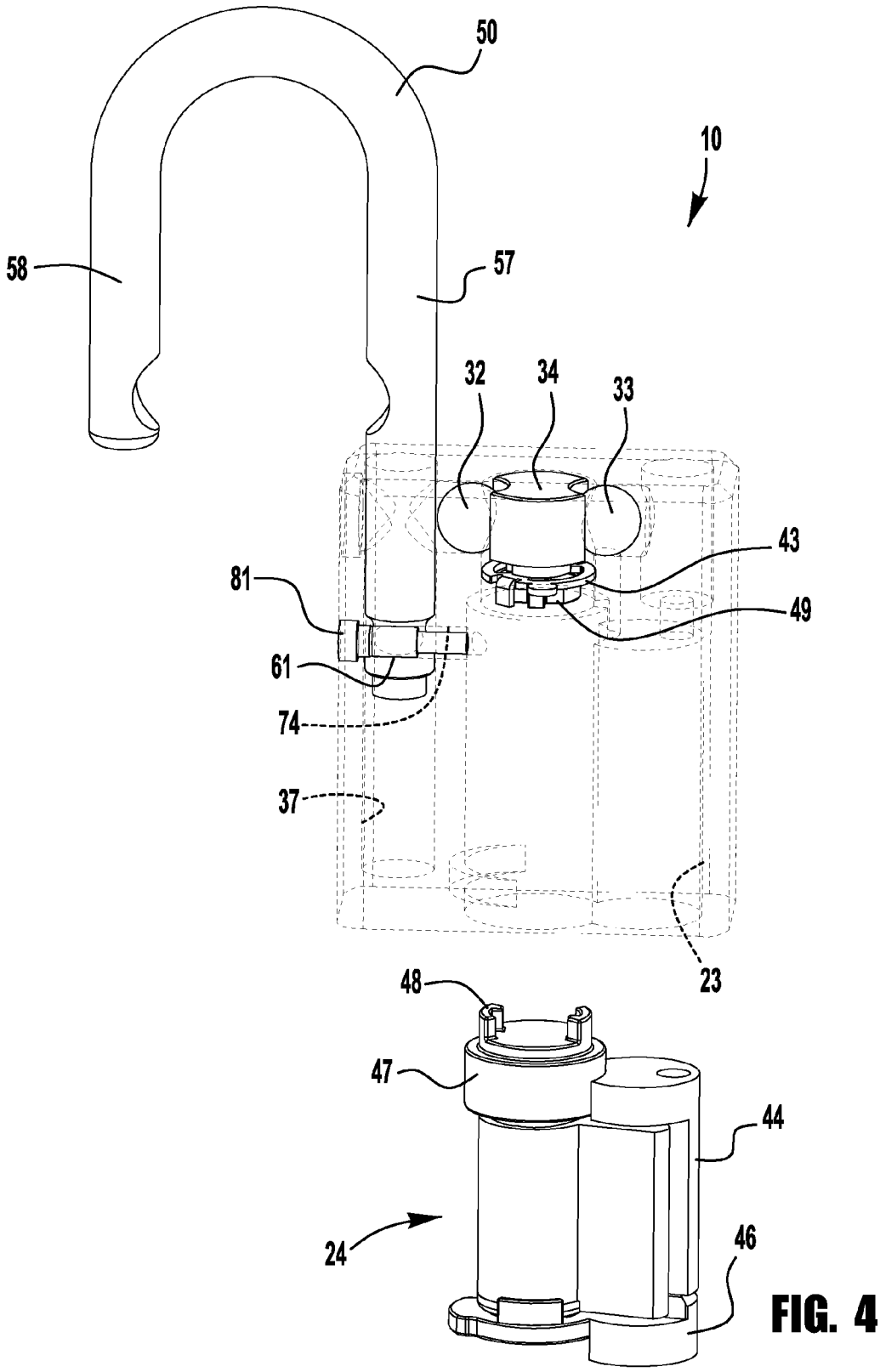
FIG. 4 is a front view of the padlock of FIG. 1, shown with the key cylinder lock removed from the lock body, with the lock body housings in phantom to illustrate additional features of the padlock.

An exemplary key cylinder padlock 10, illustrated in FIGS. 1-6, includes a lock body 20 with a first and second shackle bores 37, 38 extending from an upper end of the lock body and retaining first and second legs 57, 58 of a generally U-shaped shackle 50. A key cylinder lock 24 is disposed in a lower cavity 23 in the lock body 20, and includes a key operated plug 41 rotatable within a shell 42 (FIG. 7), using any suitable key cylinder locking arrangement, including wafer and pin tumbler locking arrangements, as known in the art. Rotation of the plug 41 rotates a driver 41*a*, which may be integral with or assembled to the plug, to directly or indirectly rotate a blocker 34 within the lock body 20 between locked and unlocked positions. In other embodiments, a sliding (non-rotating) blocker may alternatively be used. When the blocker 34 is in the locked position (FIG. 1), an outer surface of the blocker holds locking members 32, 33 in interlocking engagement with corresponding notches 52, 53 in the shackle legs 57, 58 to prevent withdrawal of the shackle to the open position. When the blocker 34 is in the unlocked position (FIG. 2), recesses 34*a*, 34*b* in the blocker align with the locking members 32, 33 to allow the locking members to disengage from the shackle notches 52, 53 when the shackle 50 is pulled toward the open position, thereby permitting separation of the short shackle leg 58 from the lock body 20 (FIG. 3).

According to an exemplary aspect of the present application, a lock subassembly (e.g., a key cylinder lock or other such locking arrangement) may be removable from a padlock when the padlock is in an unlocked condition, for example, to repair the lock subassembly or to replace the lock subassembly with a different lock subassembly. In the illustrated embodiment, the key cylinder lock 24 is assembled with a retainer 44 secured within the lower cavity 23 of the lock body 20 by a fastener 76 installed through a mounting hole 36 accessible through the shackle bore 38 of the short shackle leg. When the shackle 50 is in the open position, the fastener 76 may be loosened (FIG. 3), and the key cylinder lock 24, retainer 44 and key cylinder shield 46 may be removed from the lower cavity 23 (FIG. 4), for example, for replacement or repair.

While a removed key cylinder lock may be replaced with a dimensionally identical key cylinder lock (for example, to allow for operation of the lock using a key with a different bitting arrangement), in other embodiments, the key cylinder lock may be replaced with a dimensionally different key cylinder lock. For example, a key cylinder lock having a different length, different driver, or different cross-sectional shape may be used. To allow for assembly with a different dimensioned key cylinder lock, different retainers may be provided for assembly with the key cylinder locks, for example, to accommodate key cylinder locks of different lengths and cross-sectional shapes. Further, to permit use of key cylinder locks having different lengths, for example, 4, 5, and 6 pin tumbler key cylinders, different extensions may be assembled with the drivers of the different key cylinder lock drivers to provide for uniform engagement with, and operation of, the blocker. In the illustrated embodiment, the key cylinder lock 24 includes an extension 47 assembled with the driver 41*a* (e.g., receiving a portion of the driver in a complementary shaped recess) and includes blocker engaging projections 48 positioned to engage a lower end of the blocker 34, and to abut portions of a stop plate 43 rotationally fixed in the lock body cavity 23 to define rotational limit positions for the key cylinder lock plug 41 and extension 47.

The exemplary projections 48 of the illustrated embodiment are further sized to provide rotational clearance or "play" between the projections and the lower end of the blocker 34. This allows the key cylinder plug to be rotated back to the locked position, for example, for removal of the key, while the locking members 32, 33 hold the blocker 34 in the unlocked position, providing the key cylinder lock with a "non-key retaining" configuration. According to another aspect of the present application, a padlock may be provided with a key retaining insert positionable between a blocker and a key cylinder extension to eliminate the rotational clearance between the key cylinder extension and the blocker, such that the key cylinder plug cannot be rotated back to the locked position without first returning the shackle to the closed position (thereby permitting disengagement of the locking members from the blocker recesses to permit co-rotation of the block, key cylinder plug, and extension). In the illustrated embodiment, a key retaining insert 49 is shaped to interlock with the lower end of the blocker 34 and with the projections 48 of the extension 47, thereby eliminating any rotational clearance. By removing the key cylinder lock 24 from the lock body 20, for example, as described above, the key retaining insert 49 may be easily installed or removed to modify the lock between non-key retaining and key retaining configurations.

According to another exemplary aspect of the present application, a padlock may be configured to facilitate removal and/or replacement of the shackle, for example, to replace a damaged shackle, or to replace a shackle with a shackle of a different material, size, or shape. In one embodiment, a padlock includes a shackle retaining member, assembled with the lock body to engage the long leg of the shackle to prevent separation of the long shackle leg from the lock body. When the padlock is in an unlocked condition, the shackle retaining member may be moved to a shackle disengaging position (e.g., by moving or removing the lock subassembly to permit removal of the shackle retaining member or movement of the shackle retaining member within the lock body) to permit separation of the long shackle leg from the lock body.

In some embodiments, a locking member that engages a long shackle leg notch when in the locked condition may likewise engage an end flange of the long shackle leg. Such an arrangement may require removal of the key cylinder lock, blocker, and locking member to permit removal of the shackle from the lock body. In another embodiment, a separate shackle retainer (e.g., a pin, plate, or other suitable structure) is assembled with the lock body and is movable and/or removable to release the long shackle leg, for example, when the lock is in an unlocked condition, when the shackle is in the open position, and/or when the lock subassembly has been moved within, removed from, or partially removed from the lock body. In an exemplary embodiment, a shackle retainer extends in a lateral direction across the long shackle leg bore. The shackle retainer is received in a recess in the long shackle leg, and abuts a bottom end of the recess when the shackle is in the open position, thereby preventing removal of the shackle from the lock body. When the lock subassembly is in a normal, fully installed position disposed in the lower cavity of the lock body, the shackle retainer is blocked (e.g., by the key cylinder lock extension or some other portion of the key cylinder lock) from movement into the cavity. When the lock subassembly is manipulated to be removed from the cavity of the lock body, partially removed from the cavity, or otherwise moved to generate a space in the cavity aligned with the shackle retainer, the shackle retainer is extendable into the space in the cavity for disengagement of the shackle retainer from the long shackle leg recess, thereby permitting removal of the shackle from the lock body. The lock subassembly may be manipulated to be moved or removed, for example, by loosening a fastener securing the lock subassembly to the lock body, or by any other suitable arrangement.

In the illustrated embodiment of FIGS. 1-6, a shackle retaining pin 61 is disposed in a cross-bore 74 in the lock body 20, intersecting the long shackle leg bore 37 and the cavity 23. The shackle retaining pin 61 is received in an elongated recess 67 in the long shackle leg 57, to permit sliding movement of the long shackle leg within the shackle bore 37 when the blocker 34 is in the unlocked position. In the shackle's open position, the shackle retaining pin 61 engages a bottom end of the recess 67, which is aligned with an annular groove 54 in the long shackle leg 57 to permit pivoting movement of the shackle 50 about the long shackle leg when the shackle is in the open position. As shown, the elongated recess 67 may be spaced apart from the shackle notch 52 around a circumference of the shackle leg 57, for example, spaced approximately 90 degrees, with the notch 52 disposed on an inner lateral surface of the shackle 50, and the recess 67 disposed on a front surface of the shackle. Additionally or alternatively, the elongated recess 67 may be spaced apart from the notch 52 along a length of the shackle leg 57, such that the notch 52 is separated from the recess 67 by a full diameter portion of the shackle, which may provide for an improved shackle pull strength.

When the key cylinder lock 24 is disposed in the lower cavity 23 of the lock body 20, the shackle retaining pin 61 is blocked by the extension 47 from movement into the cavity 23. When the key cylinder lock 24 (with the extension 47) is at least partially removed from the lower cavity 23 in the lock body 20, as described above, a space in the cavity is generated in alignment with the shackle retaining pin 61. The shackle retaining pin 61 may be accessed from an exterior end of the cross-bore 74 and moved (e.g., threaded or sliding movement) within the cross-bore 74 to extend a smaller diameter end portion into the empty portion of the cavity 23, thereby disengaging the shackle retaining pin 61 from the long shackle leg 57 (FIG. 5) to permit removal of the shackle 50 from the lock body 20 (FIG. 6). As shown, the shackle retaining pin 61 may include an enlarged head 61*a* that abuts a shoulder 74*a* (FIG. 1) in the cross-bore 74 to prevent the pin 61 from disengaging from the cross-bore and falling into the cavity 23. A plug 81 may be installed in the exterior end of the cross-bore 74 to prevent ingress of contaminants into the lock body 20.

In other embodiments, a shackle retainer may be accessed through the empty cavity after removal of the lock subassembly, for example, by grasping an inner end of the shackle retainer with a tool (not shown), such that no exterior opening is provided in the lock body. In still other embodiments, a lock subassembly may include a recess or bore that aligns with a shackle retainer when the lock subassembly is moved within the cavity from a normal operating position to a shackle releasing position (not shown).

Figure 5:
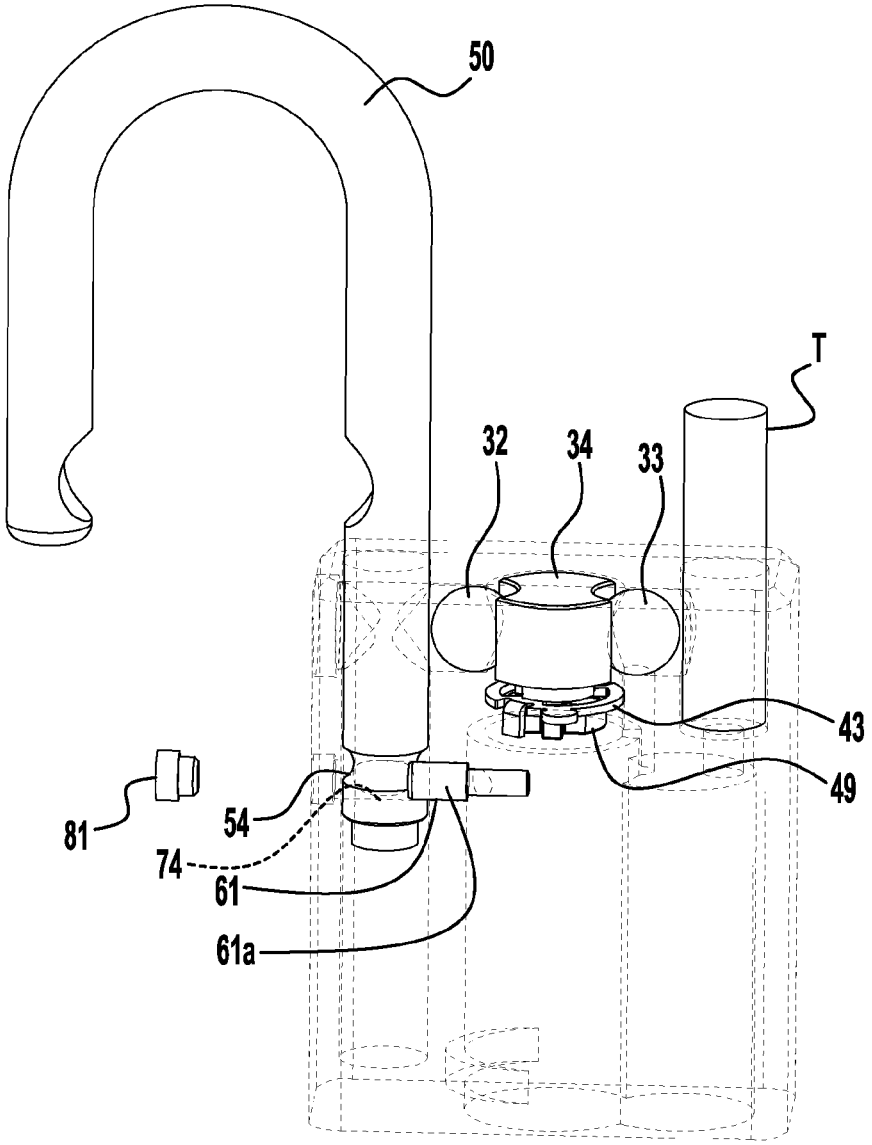
FIG. 5 is a front view of the padlock of FIG. 1, shown with the key cylinder lock removed from the lock body and the shackle retaining pin moved to the shackle releasing position, with the lock body housings in phantom to illustrate additional features of the padlock.
Figure 5:
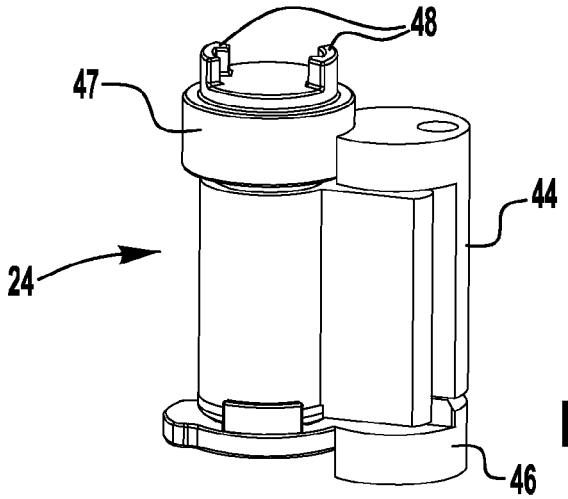
Figure 6:
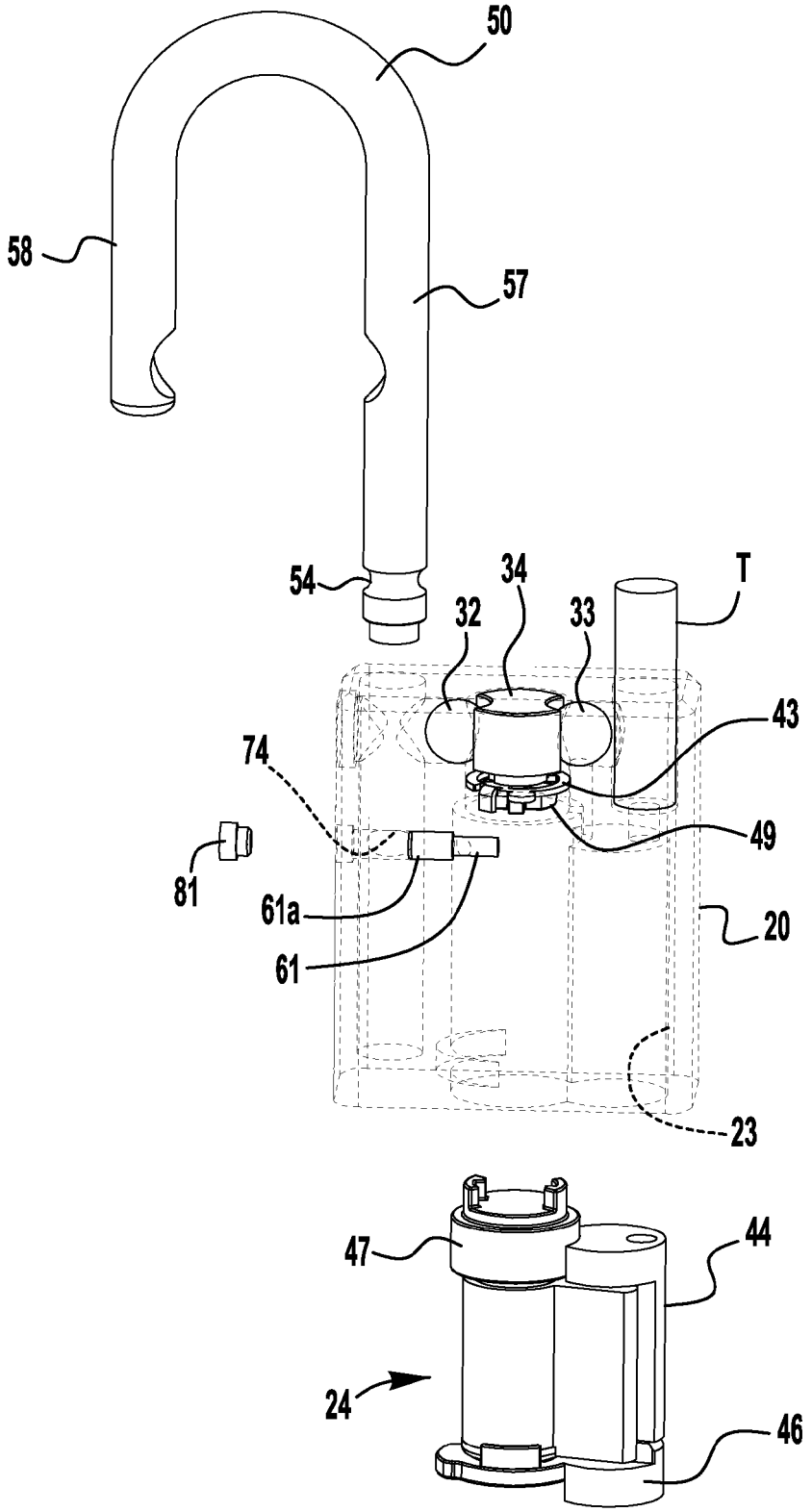
FIG. 6 is a front view of the padlock of FIG. 1, shown with the key cylinder lock and the shackle removed from the lock body, with the lock body housings in phantom to illustrate additional features of the padlock.
Figure 7:
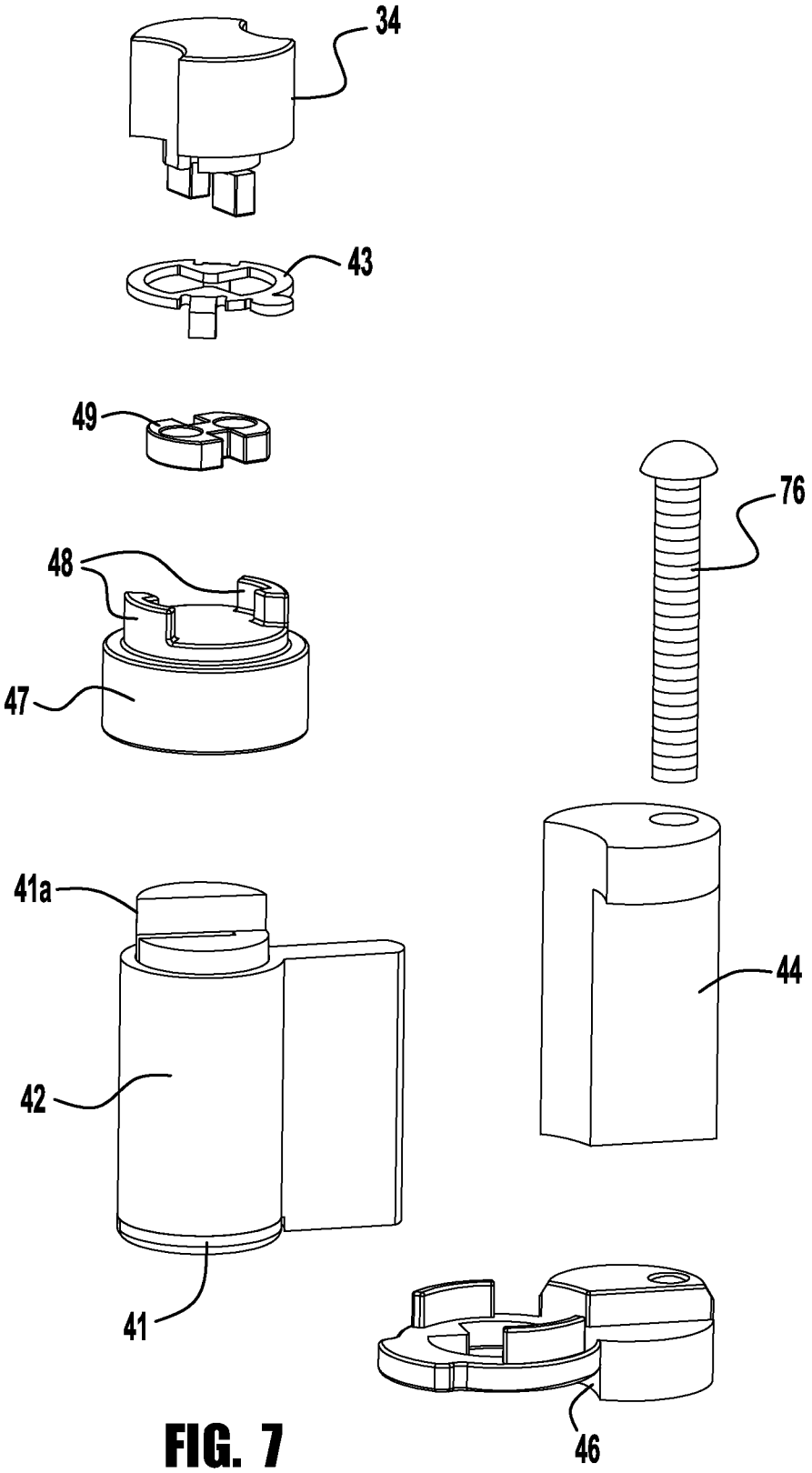
FIG. 7 is an exploded perspective view of internal lock components of the padlock of FIG. 1.
Figure 8:
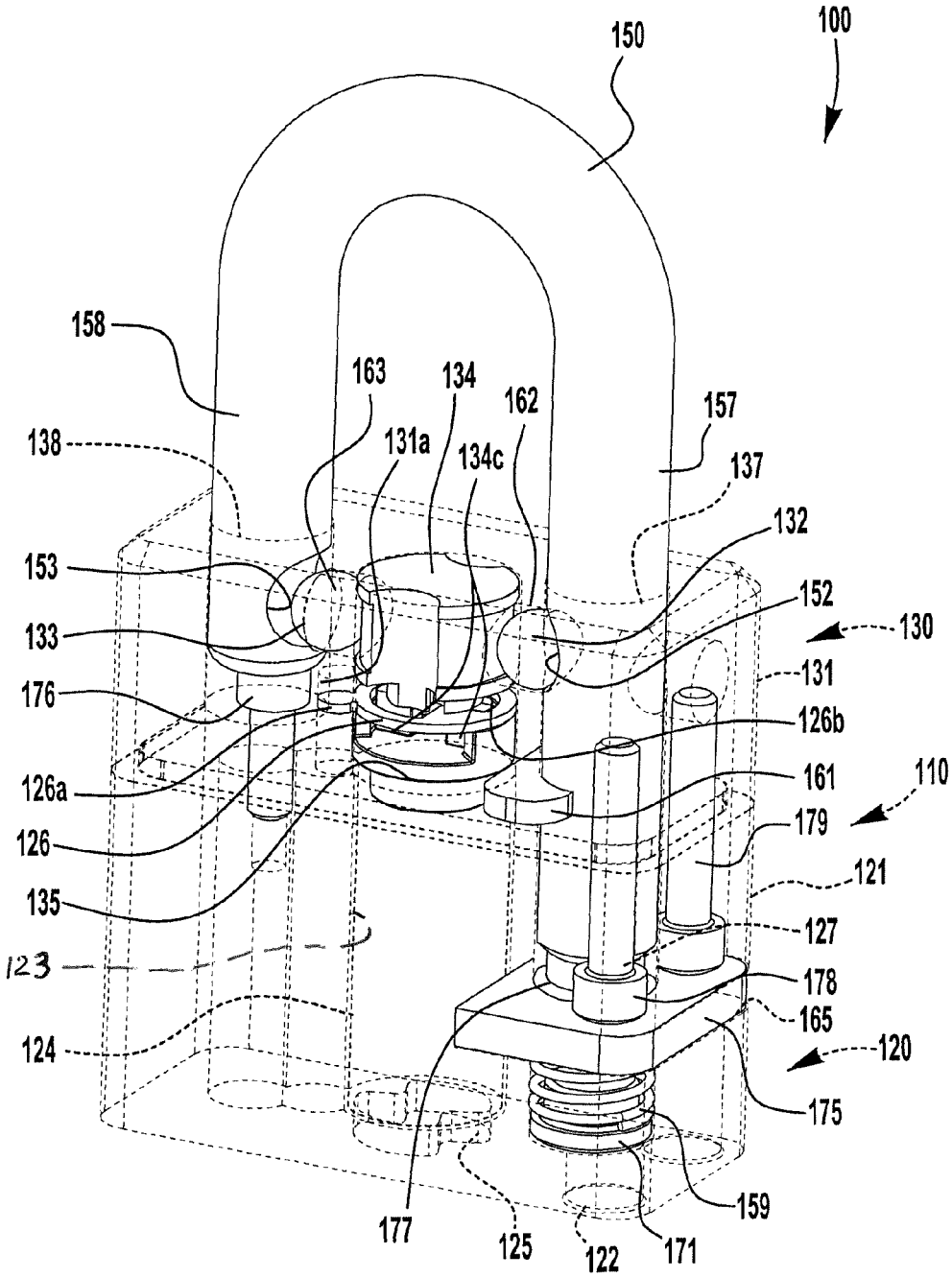
FIG. 8 is a perspective view of a padlock in accordance with an exemplary embodiment, shown in a locked condition with the lock body housings in phantom to illustrate additional features of the padlock.
Figure 9:
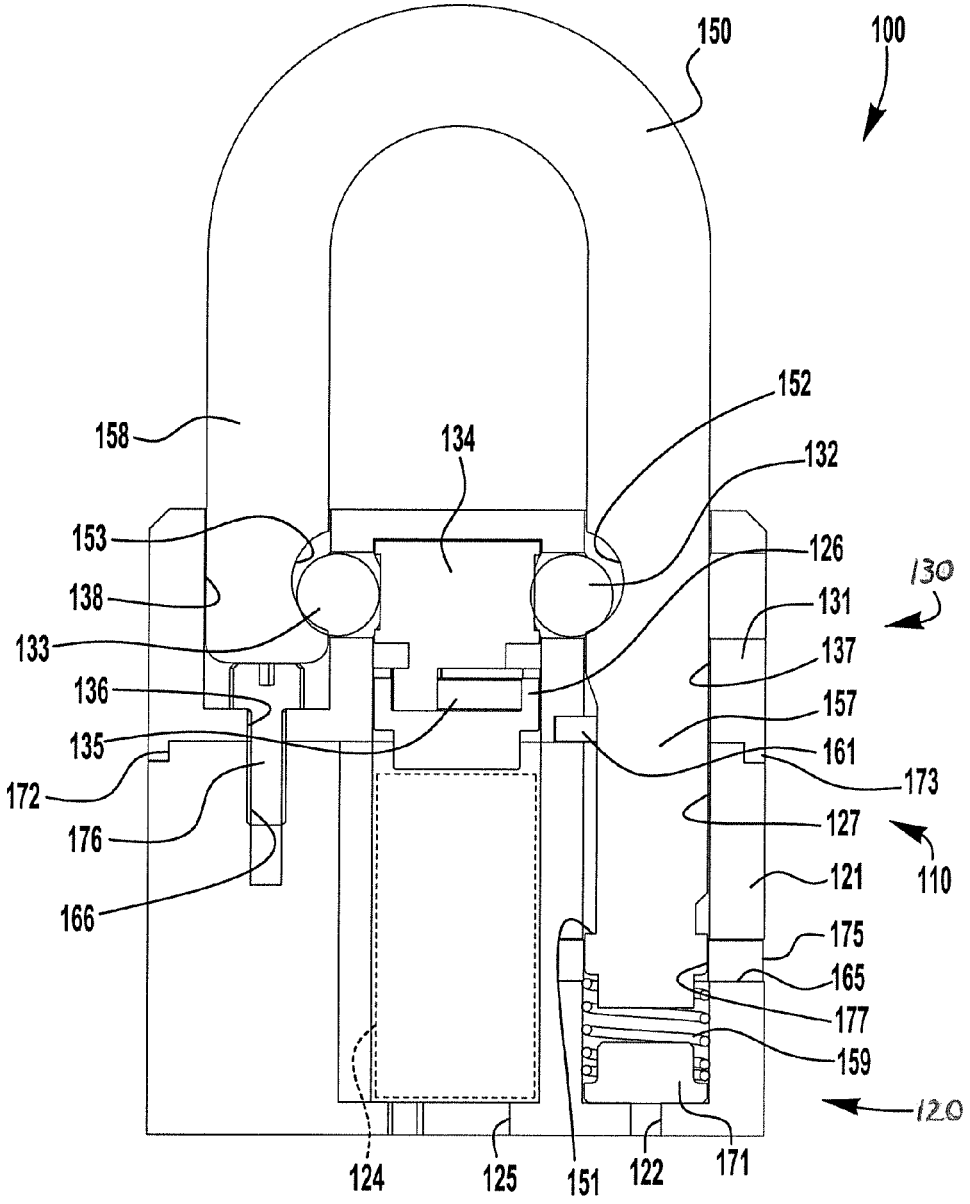
FIG. 9 is a side cross-sectional view of the padlock of FIG. 8, shown in the locked condition.
Figure 10:
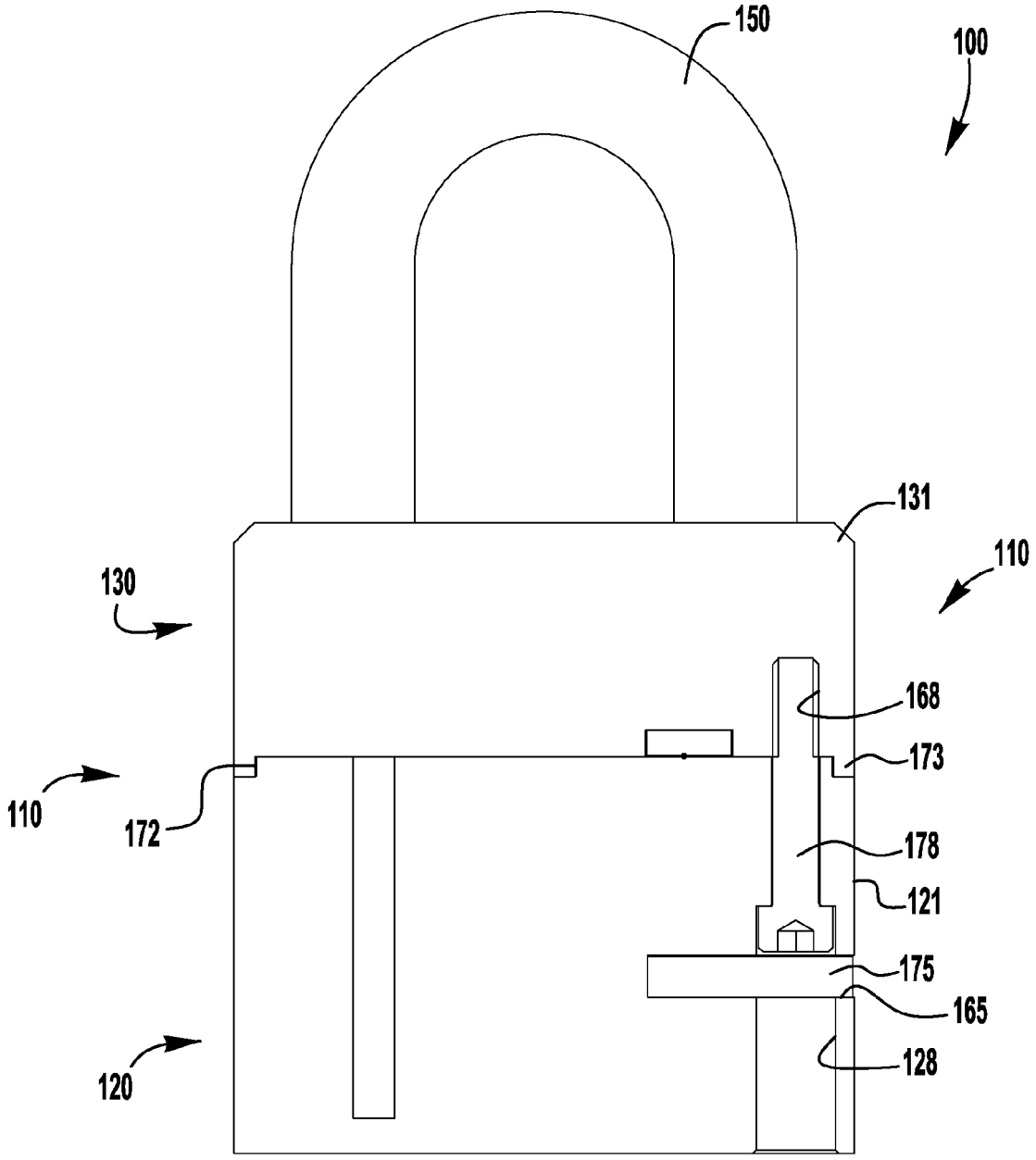
FIG. 10 is another side cross-sectional view of the padlock of FIG. 8, shown in the locked condition.

According to another aspect of the present application, as shown in FIGS. 5 and 6, when a key cylinder lock 24 is removed from a lock body cavity 23 and the short shackle leg 58 is withdrawn from the short shackle leg bore 38, a tool T may be inserted into the short shackle leg bore before the shackle 50 is fully removed from the lock body 20. The inserted tool T holds the corresponding locking member 33 in engagement with the corresponding blocker recess 34*b*, preventing rotation of the blocker 34 out of the unlocked position and a resulting misalignment with a key cylinder lock subsequently installed in the lock body cavity 23. While the tool may be provided in any suitable configuration, in an exemplary embodiment, the tool T has a cylindrical shape corresponding to the shackle bore 38.

In an exemplary method of removing a shackle 50 from a padlock 10, the padlock is unlocked by rotation of the key cylinder plug 41 using an authorized key (not shown). The short shackle leg 58 is withdrawn from the short shackle leg bore 38, and the shackle 50 is pivoted about the long shackle leg 57 to provide access to the short shackle leg bore 38. The fastener 76 within the short shackle leg bore is loosened, and the key cylinder lock 24, retainer 44, and extension 47 are removed from the lock body cavity 23 (with the blocker 34 and locking members 32, 33 remaining in the lock body 20). The shackle retaining pin 61 is pushed (e.g., by a paper clip or other such implement inserted into the cross-bore 74) to extend into an empty portion of the lock body cavity 23, thereby withdrawing from or disengaging the elongated recess 67 in the long shackle leg 57. After inserting a tool T into the short shackle leg bore 38 to hold the blocker 34 in the unlocked position, the long shackle leg 57 is fully withdrawn from the corresponding shackle bore 37 for removal of the shackle 50.

To reassemble the shackle 50 and key cylinder lock 24 with the padlock 10 (or to assembly the padlock with a new shackle or key cylinder lock), with the tool T inserted in the short shackle leg bore 38, the long shackle leg 57 is inserted into the long shackle leg bore 37 and the end of the short shackle leg 58 is brought into abutment with the upper surface of the lock body 20, thereby aligning the long shackle leg groove 54 with the cross-bore 74. With the long shackle leg 57 holding the corresponding locking member 32 in engagement with the corresponding blocker recess 34*a*, the tool T may be removed from the short shackle leg bore 38. Using a finger or other implement inserted into the cavity 23, the shackle retaining pin 61 is pushed out of the cavity and into alignment with the long shackle leg groove 54. The key cylinder lock 24, key cylinder lock retainer 44, and extension 47 are inserted into the cavity 23, and the fastener 76 is installed through mounting hole 36 and assembled with the retainer 44 to secure the key cylinder lock 24 and retainer 44 with the lock body.

According to another exemplary aspect of the present application, a portable lock (e.g., a padlock) may include a lock body having two or more separate sections, for example, to facilitate assembly, customization, inventory control, and field maintenance and/or modification. In one such exemplary embodiment, a portable lock includes a locking body section that retains a shackle (or other such lock member) securing mechanism (e.g., locking balls and a rotating blocker), and a separate lock interface body section that retains a key cylinder (or other such lock interface) that operatively connects with the shackle securing mechanism. By providing the lock member securing mechanism and the lock interface in separate body sections, a wide variety of portable locks may be efficiently produced without maintaining excessive inventory of individual unassembled components or fully assembled locks. For example, a single locking body section may be used with a variety of lock interface body sections, for example, to provide for a variety of key cylinder types and sizes, as well as other types of lock interfaces, such as combination dial and electromechanical locking arrangements. As another example, a single lock interface body section may be used with a variety of locking body sections, for example, to provide for key retaining or non-key retaining operability, or to facilitate use with different types of lock members (e.g., different sized shackles, cables, pins, etc.). These adaptations or customizations may be performed by a manufacturer, retailer, service professional (e.g., locksmith), or end user.

While a portable lock may be produced by permanently assembling a locking body section and a lock interface body section (e.g., by welding, riveting, staking, etc.), in another exemplary embodiment, a locking body section may be detachably assembled with the lock interface body section, such that the body sections may be detached for maintenance, modification, or replacement. To prevent unauthorized disassembly of a lock, a body section attachment arrangement may be configured such that the lock must be unlocked to permit detachment of the body sections. For example, access to the body section attachment arrangement may be blocked when the lock is in a locked condition. In one exemplary embodiment, first and second sections of a padlock body may be attached by at least one fastener (e.g., a bolt or screw) that is blocked or covered by a portion of the padlock shackle when the shackle is secured in the lock body in a locked condition. When the padlock is unlocked and the shackle is withdrawn from the lock body, the fastener is exposed and accessible for disassembly. In another exemplary embodiment, first and second sections of a padlock body may be attached by at least one fastener that is blocked or covered by a shield member that is assembled with the lock body. When the padlock is in the locked condition, the shield member is secured with the lock body to block access to the fastener. When the padlock is in the unlocked condition, the shield member is movable or removable to permit access to the fastener for separation of the body sections.

FIGS. 8-18 illustrate an exemplary padlock 100 having a shackle 150 and a lock body 110 including a lower lock interface body section 120 and an upper locking body section 130. The lock interface body section 120 includes a first, lower housing 121 having a central bore 123 that retains a key cylinder (shown schematically at 124) having a keyway accessible through a key opening 125 in the bottom of the housing 121. The locking body section 130 includes a second, upper housing 131 that retains first and second locking balls 132, 133 in locking ball bores 162, 163 and a central bore 139 that aligns with the lower housing central bore 123 to retain a blocker 134 that is rotationally connected to the key cylinder 124 by a key cylinder adapter 135 that extends into both central bores 123, 139. A stop plate 126 secured with the upper housing 131 (e.g., by a tab 126*a* received in a corresponding cutout 131*a*) limits rotation of the blocker 134 (e.g., by a cutout 126*b* shaped to engage posts 134*c* of the blocker 134 in rotational limit positions). To accommodate use with a lock interface body section having a different key cylinder or other such mechanism (not shown), the key cylinder adapter 135 may be replaced with a different adapter specifically configured for use with the different mechanism.

The upper housing 131 includes first and second shackle bores 137, 138 that receive corresponding long and short legs 157, 158 of the shackle 150. The lower housing 121 includes a shackle bore 127 that aligns with the first shackle bore 137 of the upper housing 131 to receive the long shackle leg 157. When the key cylinder 124 is in a locked position, the blocker 134 is rotationally positioned to hold the locking balls 132, 133 in interlocking engagement with corresponding notches 152, 153 in the shackle legs 157, 158, thereby securing the shackle 150 against withdrawal from the lock body 110. When the key cylinder 124 is in an unlocked position (FIG. 11), recesses 134*a*, 134*b* in the blocker 134 align with the locking balls 132, 133 to allow the locking balls to disengage from the shackle notches 152, 153, and a compression spring 159 below the long shackle leg 157 biases the shackle 150 toward a withdrawn or open position, in which the short shackle leg 158 separates from the lock body 110. The spring 159 is centered by a spring post 171 seated in the shackle bore 127 of the lower housing 121. A shackle stop 161 disposed in a lower recess in the upper housing 131 engages a shoulder 151 on the long shackle leg 157 to prevent removal of the long shackle leg 157 from the lock body 110.

Figure 20:
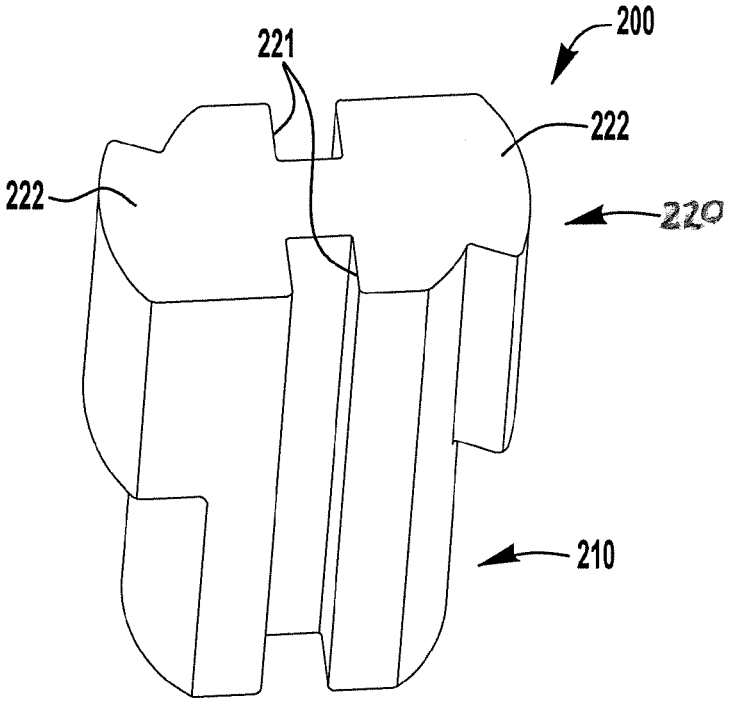
FIG. 20 is a perspective view of a tool for inserting into a central blocker retaining bore of a lock housing to secure the blocker in a predetermined rotational orientation.
Figure 21:
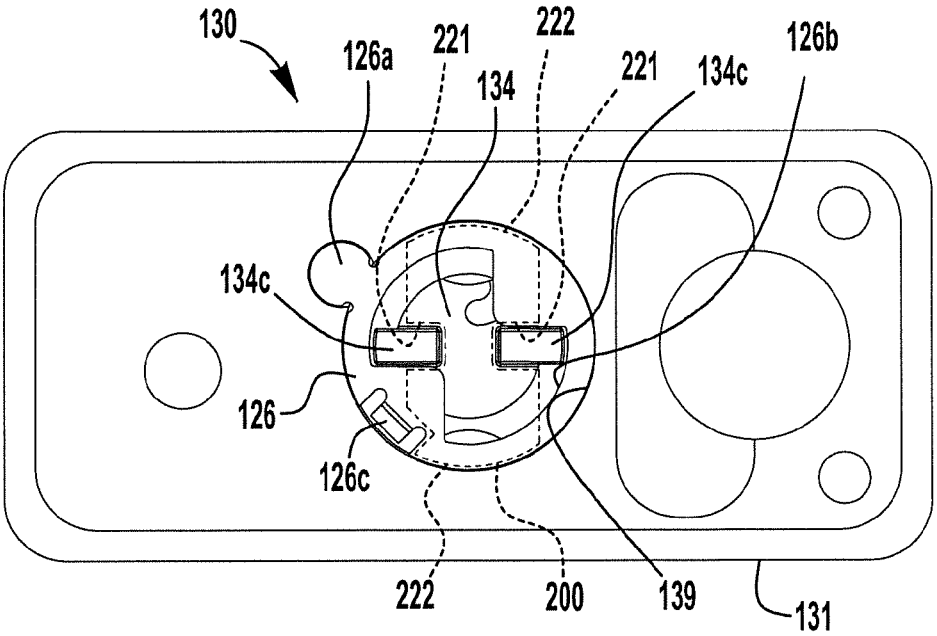
FIG. 21 is a bottom view of the upper body section of the padlock of FIG. 8, with an inserted blocker positioning tool shown in phantom.

In an exemplary embodiment, the blocker 134 is rotationally biased, for example, by a torsion spring (not shown) toward the locked orientation forcing the locking balls 132, 133 outward. In such an embodiment, this forced outward condition of the locking balls blocks insertion of the long shackle leg 157. To properly assemble the shackle 150 with the upper housing 131, the blocker 134 may be held against this rotational bias in the unlocked orientation to allow the locking balls to be displaced inward during insertion of the long shackle leg 157. The blocker 134 may be held in the unlocked orientation by an inserted tool or direct user engagement. In an exemplary embodiment, as shown in FIG. 20, an exemplary tool 200 includes a user graspable portion 210, which may be provided in any suitable shape, and an insertion portion 220 sized to be inserted into the upper housing central bore 139 from a bottom surface of the upper housing 131 to secure the blocker 134 in the unlocked orientation. The exemplary insertion portion 220 includes notched portions 221 that receive the posts 134*c* of the blocker 134 and a tang portion 222 that interlocks with a downward extending projection 126*c* of the stop plate 126 (see FIG. 13) to rotationally secure the blocker 134 with respect to the stop plate 126 in an unlocked orientation, as shown in FIG. 21. As shown, the insertion portion 220 may be provided with a pair of tang portions 222 to allow for insertion of the tool 200 in either of two rotational orientations. The tool 200 may be held in place by a friction fit between the tool 200 and the upper housing bore 139, and/or by the rotational biasing force applied to the blocker 134.

To detachably secure the lower and upper housings 121, 131 of the exemplary lock 100, the upper housing includes a fastener hole 136 extending from the second shackle bore 138 in alignment with a threaded bore 166 in the lower housing 121 to receive a threaded upper fastener 176 securing the upper housing 131 to the lower housing 121. When the shackle 150 is in the closed position, access to the upper fastener 176 is blocked by the shackle 150. When the shackle is in the withdrawn or open position, the upper fastener 176 is accessible, for example, with a screwdriver or hex key (e.g., a 7/64" Allen wrench) to remove the upper fastener 176 from the assembly.

As shown in the illustrated embodiment, lower and upper housings 121, 131 may be additionally or alternatively secured together by one or more lower fasteners 178, 179 installed through fastener holes 128, 129 in the lower housing 121 and threaded into corresponding threaded bores 168, 169 in the upper housing 131. To block access to the installed fasteners 178, 179 to prevent unauthorized disassembly of the lock 100, a shield member 175 is installed into a notch 165 in the lower housing 121 below the installed lower fasteners 178, 179. While many different arrangements may be utilized to secure the shield member 175 in a position blocking access to the fasteners 178, 179, in the illustrated embodiment, the shield member 175 includes an aperture 177 (e.g., a hole, notch, or cutout) that receives the long leg 157 of the shackle 150 at least when the shackle 150 is in the closed or locked position.

Figure 11:
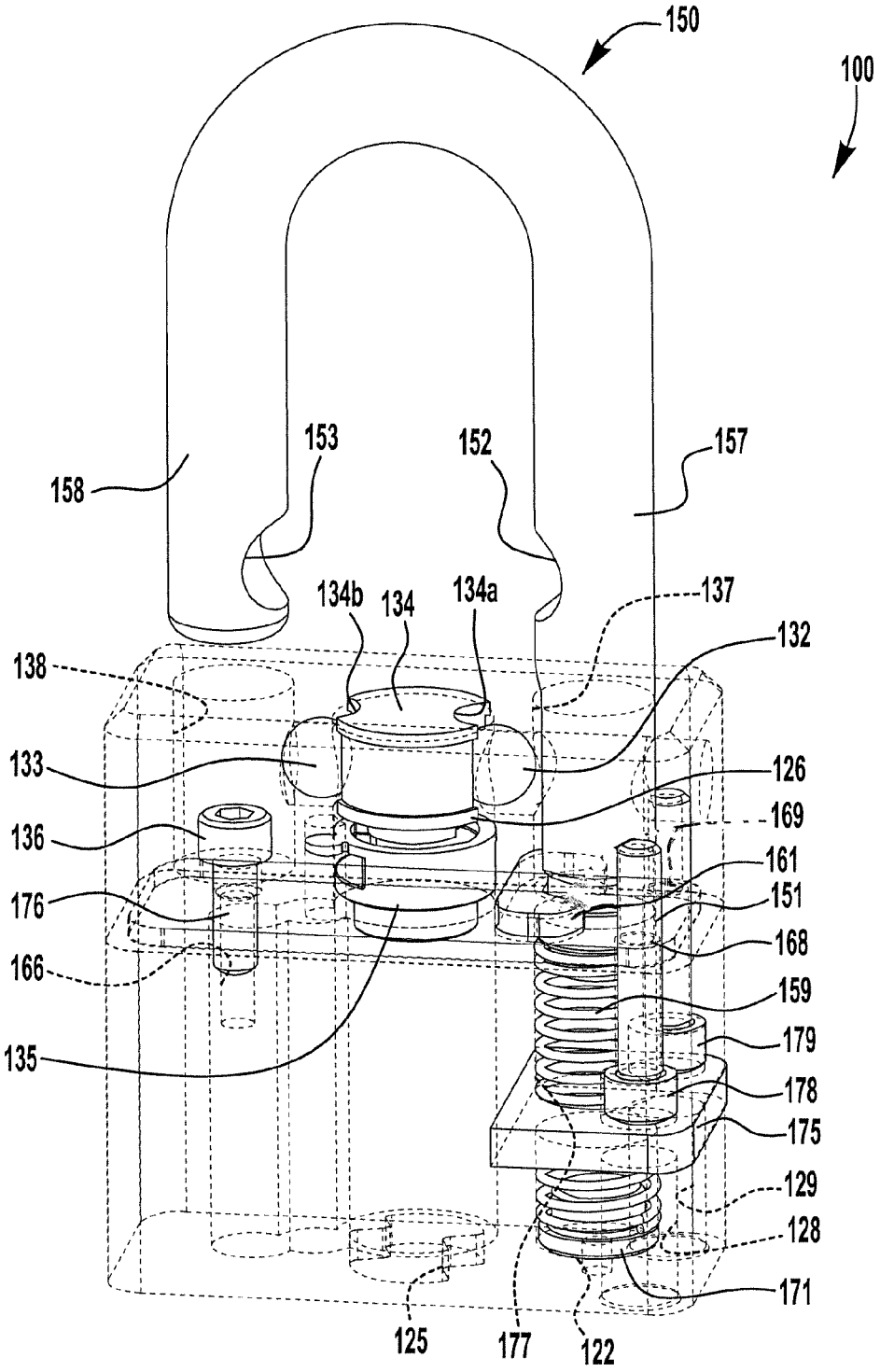
FIG. 11 a perspective view of the padlock of FIG. 8, shown in an unlocked condition with the lock body housings in phantom to illustrate additional features of the padlock.
Figure 12:
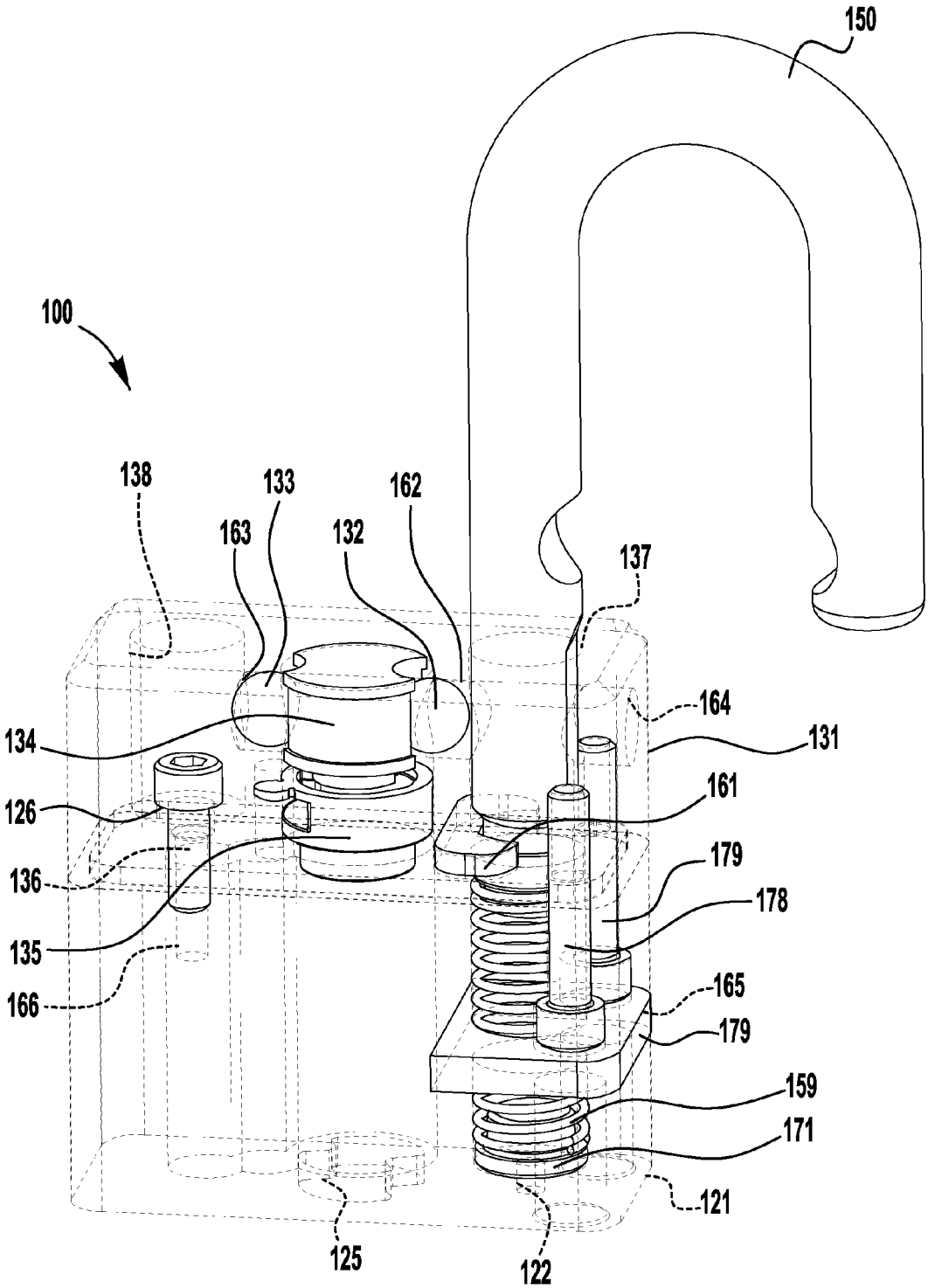
FIG. 12 is a perspective view of the padlock of FIG. 8, shown in an unlocked condition with the shackle pivoted out of alignment with the short leg shackle bore, with the lock body housings shown in phantom to illustrate additional features of the padlock.
Figure 13:
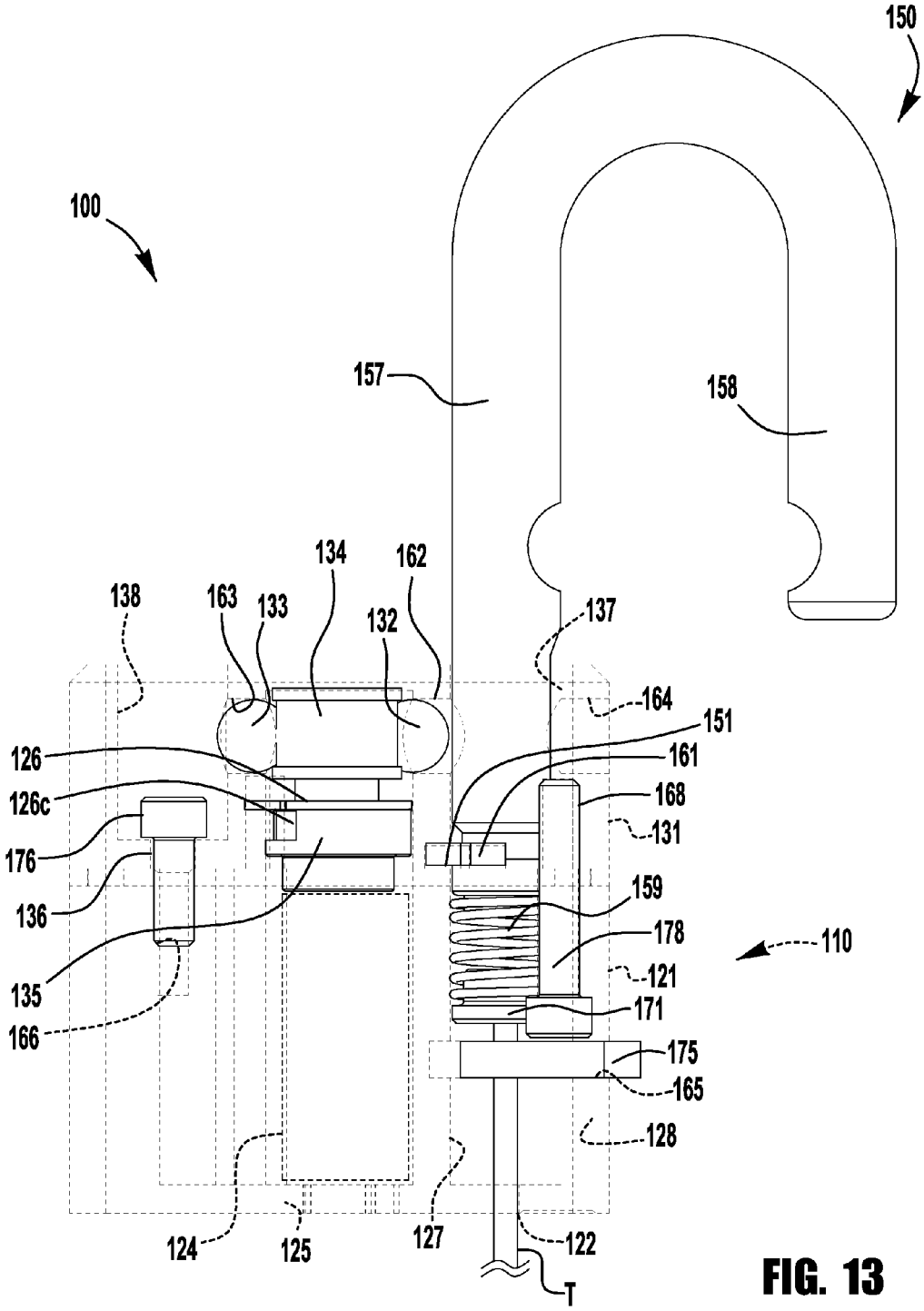
FIG. 13 is a perspective view of the padlock of FIG. 8, shown in an unlocked condition with the spring post and compression spring raised to a shield member removal position, with the lock body housings shown in phantom to illustrate additional features of the padlock.
Figure 14:
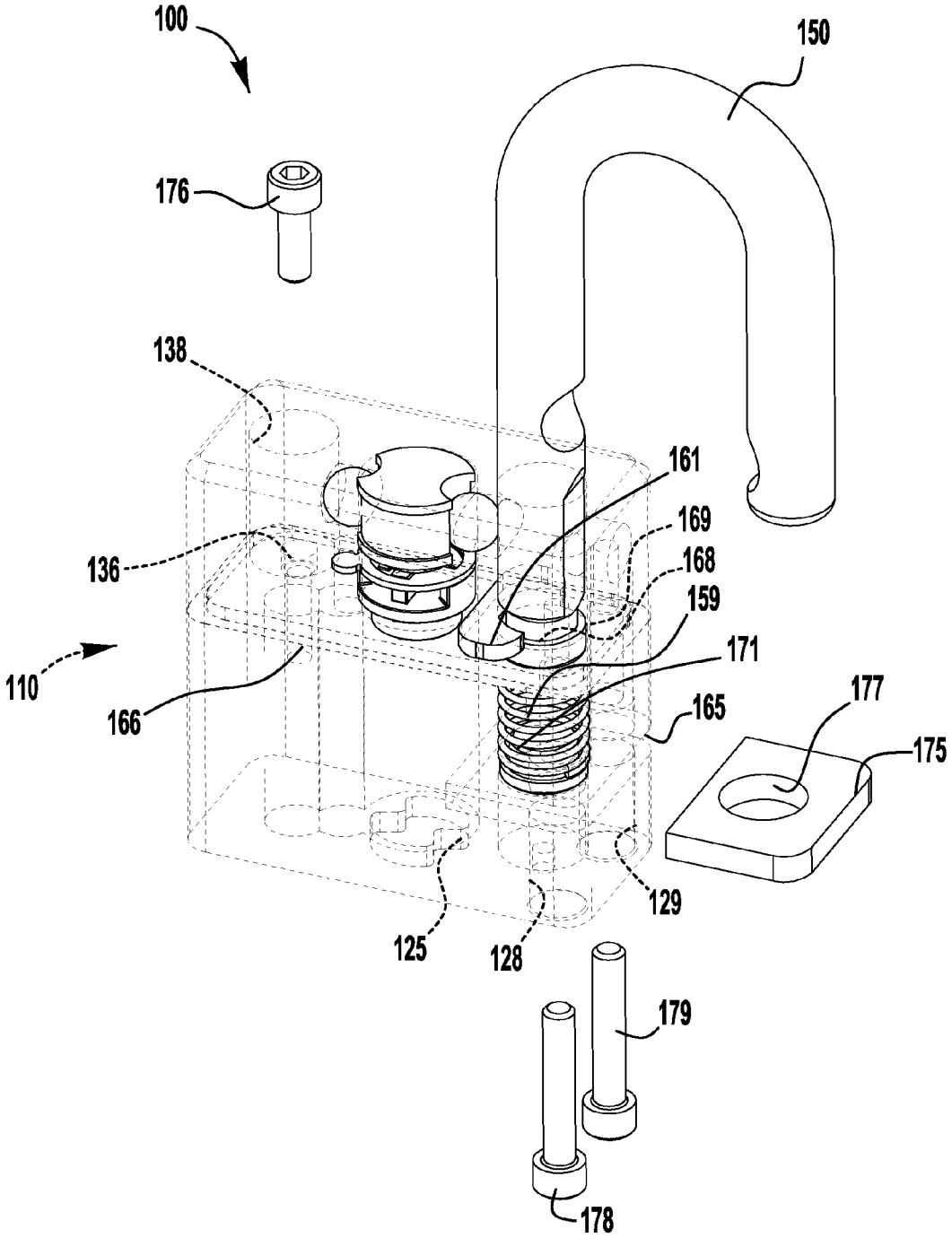
FIG. 14 is a perspective view of the padlock of FIG. 8, shown with the shield member and fasteners removed, with the lock body housings shown in phantom to illustrate additional features of the padlock.
Figure 15:
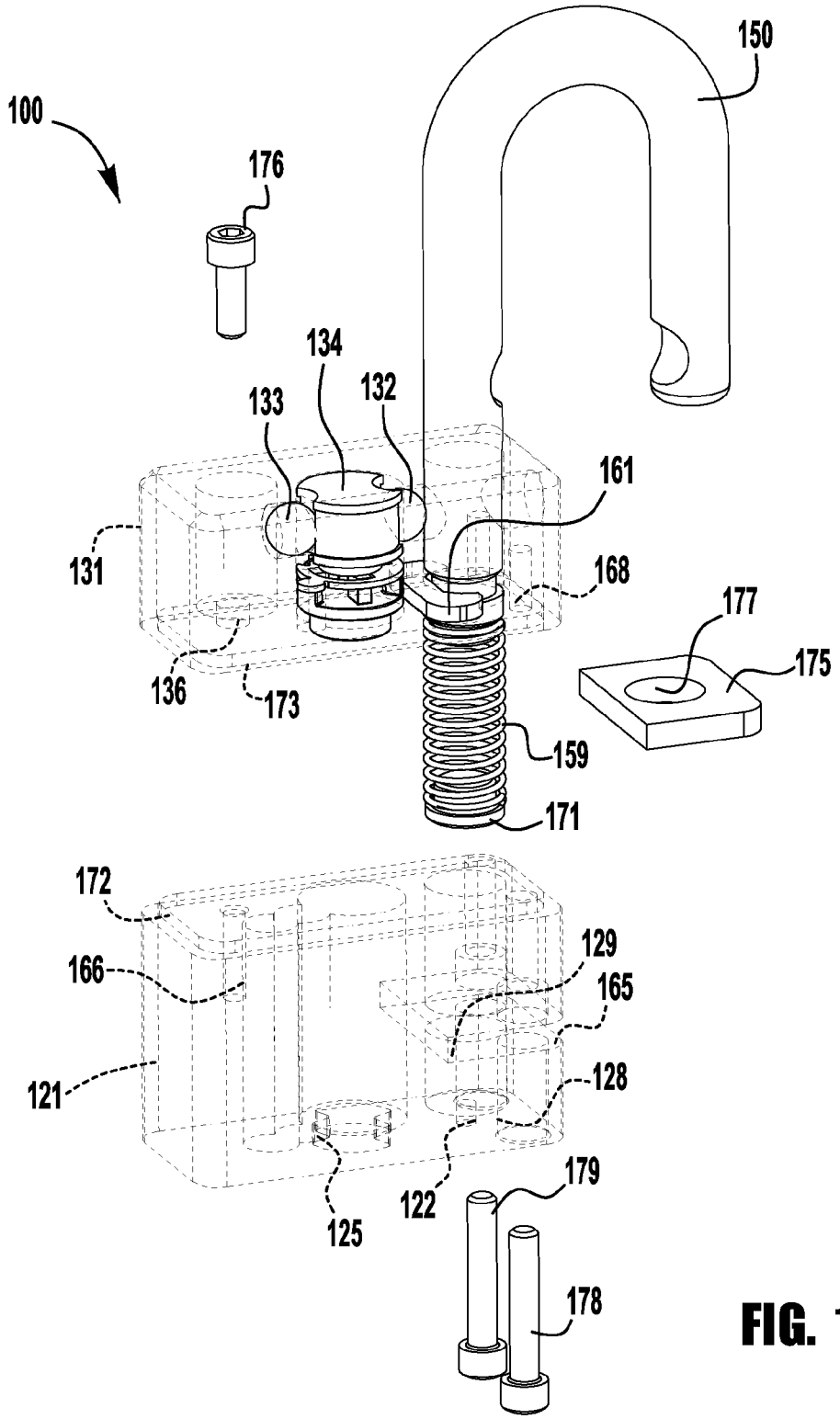
FIG. 15 is a perspective view of the padlock of FIG. 8, shown with the upper and lower lock body sections separated, with the lock body housings shown in phantom to illustrate additional features of the padlock.
Figure 16:
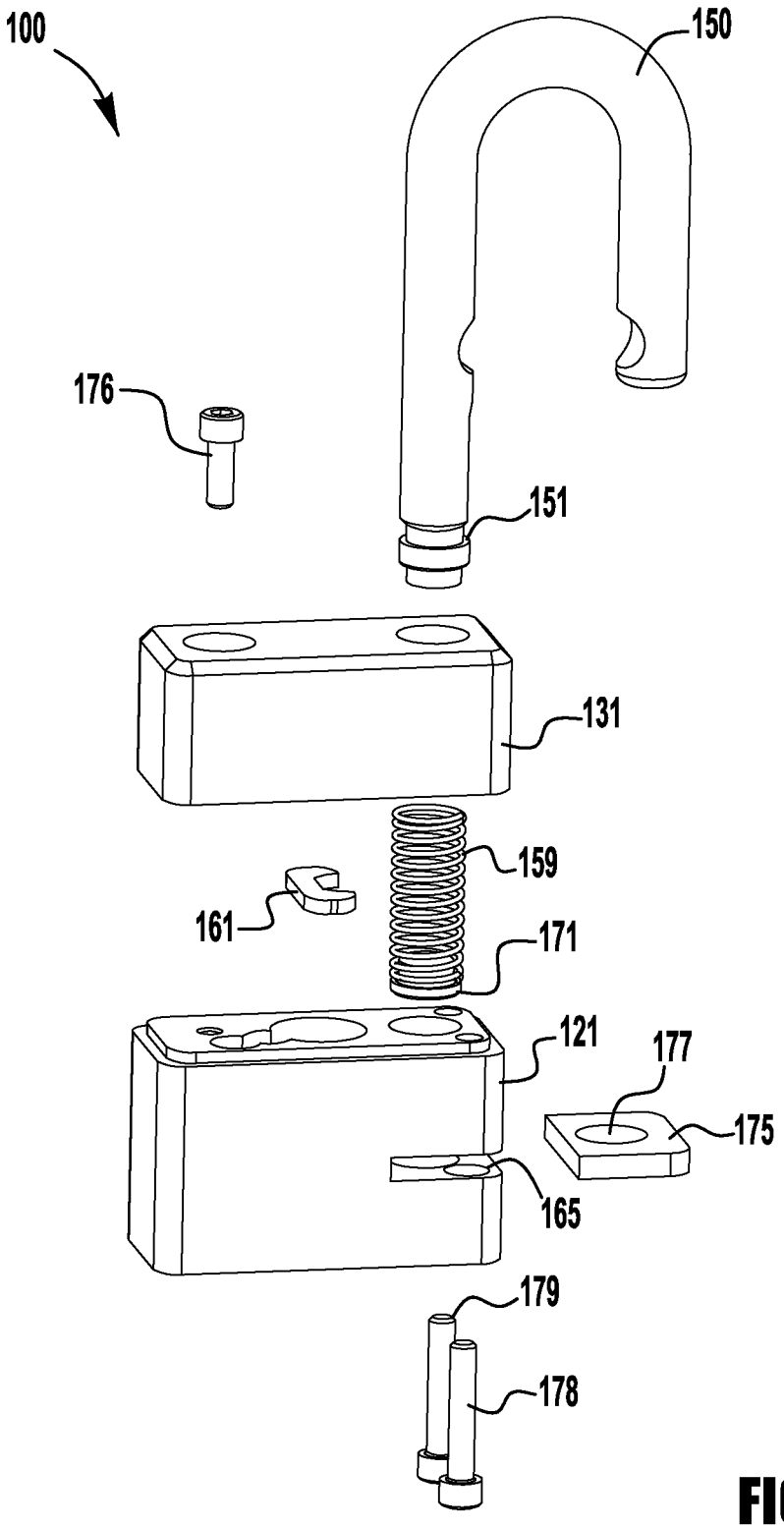
FIG. 16 is a perspective view of the padlock of FIG. 8, shown with the upper and lower lock body sections separated and the shackle removed from the upper lock body section.

To detach the lower and upper housings 121, 131 of the exemplary lock 100, the shackle 150 is raised or withdrawn from the lock body 110 to withdraw the long leg 157 of the shackle from the shield member aperture 177 (FIG. 11). The shackle 150 is pivoted out of alignment with the second shackle bore 138 of the upper housing 131 to expose the upper fastener 176 (FIG. 12). A tool T is inserted through an opening 122 in the first lock housing 121 that is aligned with the shackle bore 127 to raise the spring post 171 and compression spring 159 past the shield member 175, allowing the shield member to be dislodged from the notch 165 in the lower housing 121 (FIG. 13). In one embodiment, the opening 122 also functions as a drain hole to allow for drainage of moisture entering the lock body 110. The opening 122 may be sized to receive any appropriate tool, including, for example, the same tool used to remove one or more of the fasteners 176, 178, 179. Upon removal of the shield member 175 (FIG. 14), the lower fasteners 178, 179 are accessed and removed through the lower housing fastener holes 128, 129. The upper fastener 176 is accessed and removed through the second shackle bore 138 in the upper housing 131. Upon removal of the fasteners 176, 178, 179, the lower housing 121 may be separated from the upper housing 131 (FIG. 15). The shackle stop 161 may then be removed from the upper housing 131, allowing for removal of the shackle 150 from the upper housing 131 (FIG. 16), for example, to replace the shackle 150 with a different size or material shackle.

To assemble or reassemble the lock 100 (or a modified lock), the blocker 134 is held in the unlocked orientation (for example, by using the tool 200 of FIG. 20, as described above), and the long leg 157 of the shackle 150 (or a replacement shackle) is inserted through the first shackle bore 137 of the upper body section 130 (or a replacement upper body section). The shackle stop 161 is installed in the upper housing 131 to retain the shackle long leg 157. The spring post 171 and compression spring 159 are installed in the shackle bore 127 of the lower body section 120 (or a replacement lower body section). The upper body section 130 is joined with the lower body section 120 and the upper and lower fasteners 176, 178, 179 are installed in the corresponding threaded bores 166, 168, 169 to attach the lower and upper housings 121, 131. The tool T is inserted through the tool opening 122 to raise the spring post 171 and compression spring 159 about the lower housing notch 165, and the shield member 175 is installed in the notch 165. The spring post 171 and compression spring 159 are then released to extend through the shield member aperture 177.

Other features may be provided to facilitate construction, assembly, and security of the lock. For example, a side access bore 164 may be machined in the upper housing 131 to facilitate machining of the locking ball bores 162, 163. As another example, edges of the locking ball bores 162, 163 may be crimped to prevent the locking balls 132, 133 from being dislodged or lost when the shackle 150 is removed. As still another example, the upper housing 131 may be provided with an outer lip 173 that interlocks with an outer shoulder 172 of the lower housing 121 (FIGS. 10 and 15), for example, to facilitate alignment of the housings 121, 131, and/or to impede efforts to pry apart the housings 121, 131.

Figure 17:
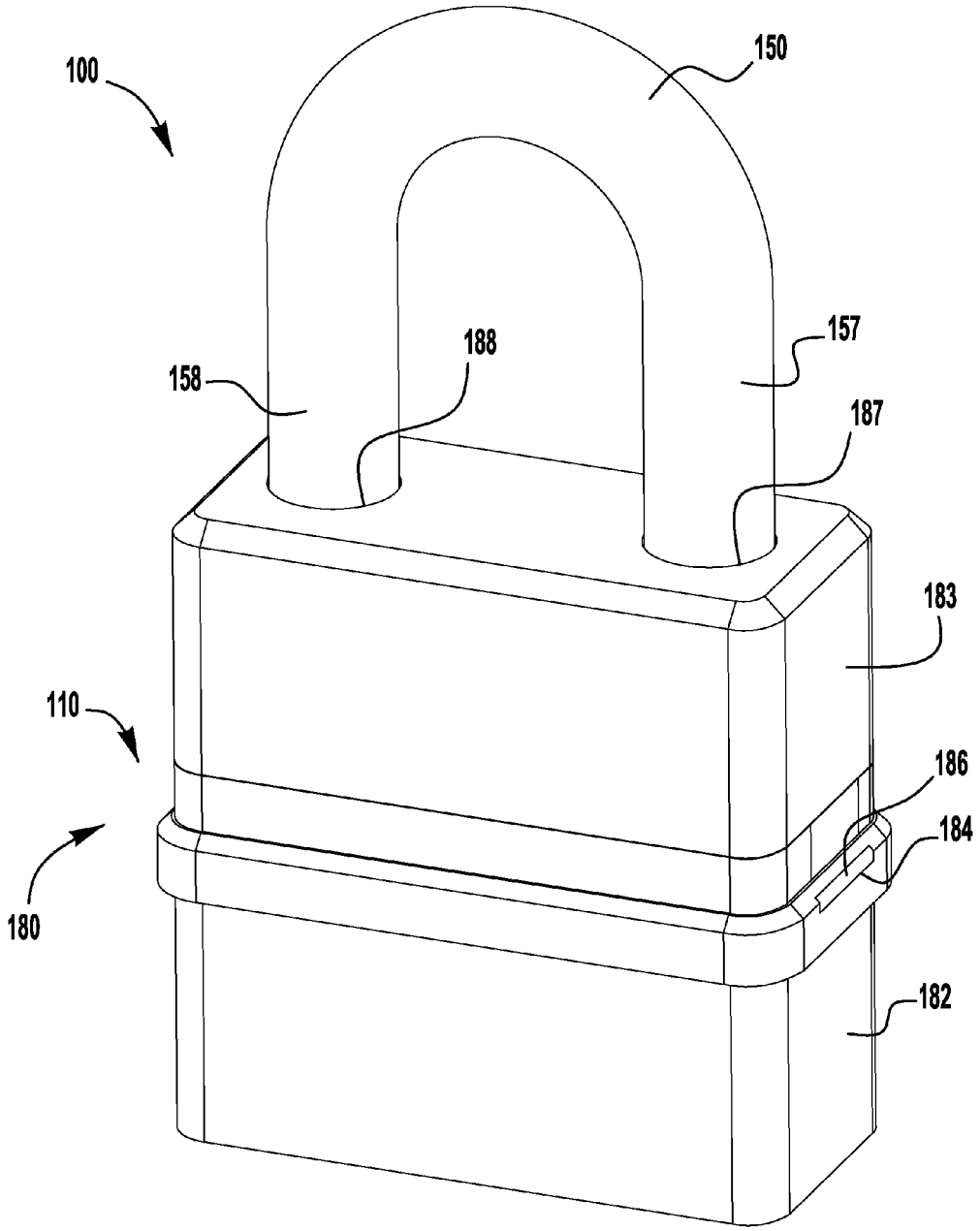
FIG. 17 is an upper perspective view of a padlock having a protective shell assembled over the lock body, in accordance with an exemplary embodiment.
Figure 18:
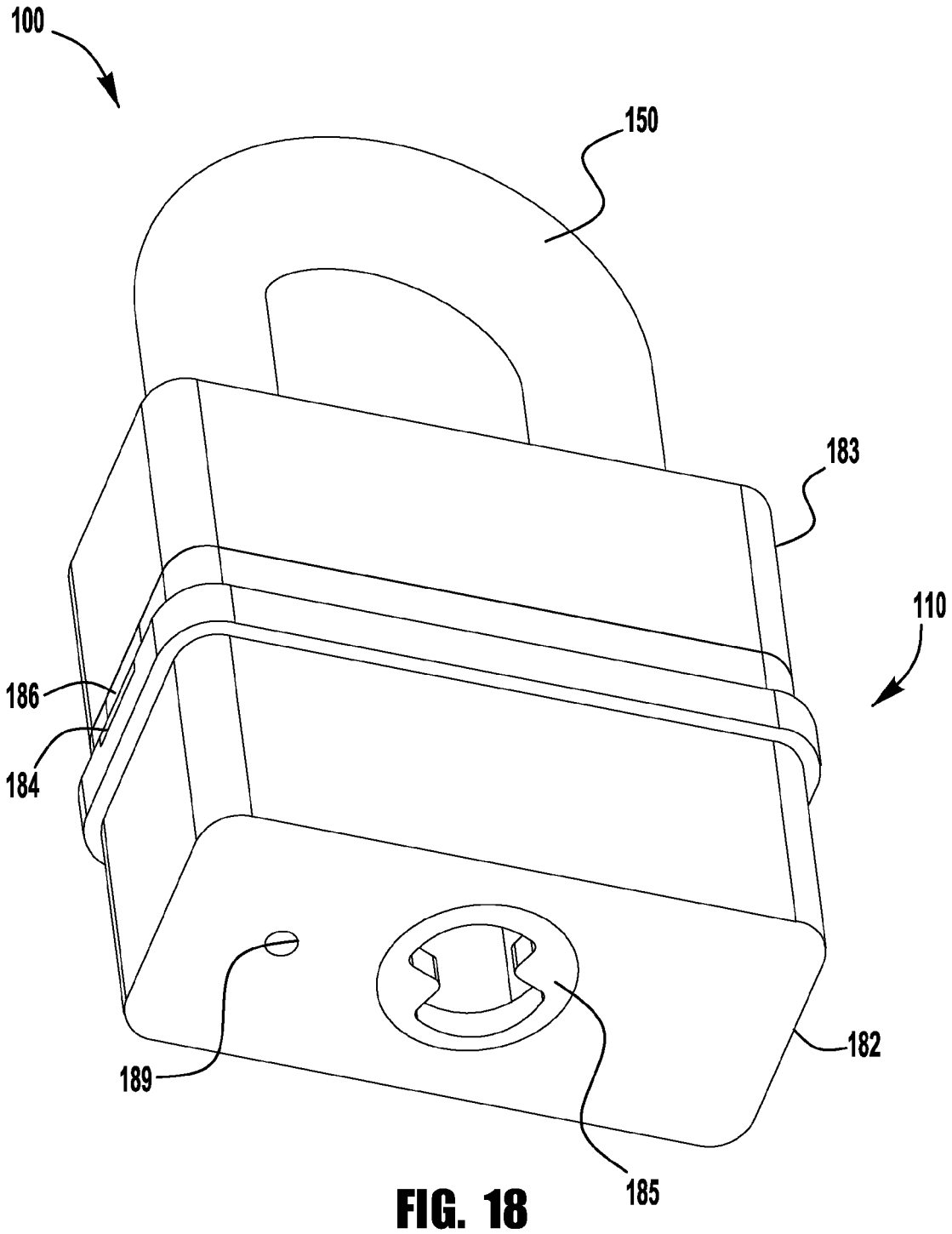
FIG. 18 is a lower perspective view of the padlock of FIG. 17.
Figure 19:
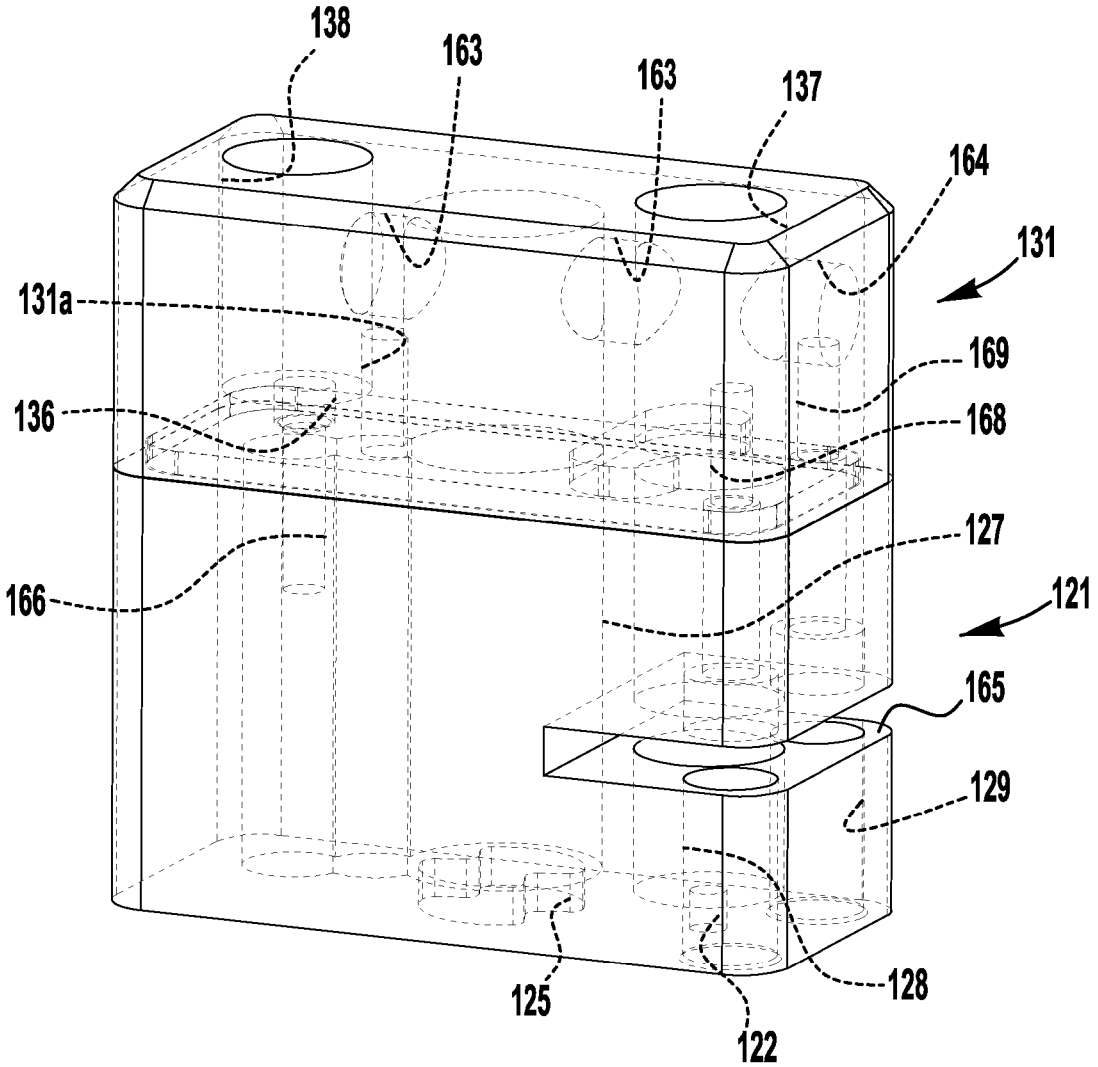
FIG. 19 is a perspective view of the lock housings of the padlock of FIG. 8, shown in phantom.

As yet another example, as shown in FIGS. 17 and 18, an outer shell or jacket 180 may be assembled over the lock body 110 to protect the seams, openings, and notches in the lock housings 121, 131, and the exposed internal components, for example, from corrosion and contamination. While any protective shell may be utilized, in the illustrated embodiment, the shell 180 includes an upper section 183 having shackle openings 187, 188 to receive the shackle legs 157, 158, and a lower section 182 having a keyway opening 185 to permit access to the keyway and a tool access opening 189 to permit insertion of a tool in the tool opening 122. As shown, the lower and upper sections 182, 183 of the shell may be secured together by detent tabs 184 on the lower section 182 that releasably interlock with slots 186 in the upper section 183. Alternatively (not shown), the upper section may be provided with detent tabs that releasably interlock with slots in the lower section.

While various aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, devices and components, alternatives as to form, fit and function, and so on—may be described herein, such descriptions are not intended to be a complete or exhaustive list of available alternative embodiments, whether presently known or later developed. Those skilled in the art may readily adopt one or more of the aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

We claim:

1. A padlock comprising:

a lock body;

a shackle assembled with the lock body;

a lock subassembly disposed in a cavity in the lock body and operable between a locked position securing the shackle in a closed position and an unlocked position permitting movement of the shackle to an open position; and a shackle retaining pin assembled with the lock body, the shackle retaining pin including a first end portion having a first diameter and a second end portion having a second diameter smaller than the first diameter, the first end portion being disposed in a first shackle bore and received in a recess in a first leg of the shackle disposed within the first shackle bore, the second end portion extending into a cross-bore in the lock body, the cross-bore intersecting the first shackle bore and the cavity;

wherein when the shackle is in the open position, the lock subassembly is manipulable to be moved from a first position to a second position to align an empty portion of the cavity with the shackle retaining pin, such that the second end portion of the shackle retaining pin is extendable into the empty portion of the cavity for disengagement of the shackle retaining pin from the first shackle leg recess, thereby permitting removal of the shackle from the lock body, with the first end portion of the shackle retaining pin abutting a shoulder surface in the cross-bore to prevent the first end portion of the shackle retaining pin from entering the cavity.

2. The padlock of claim 1, wherein the lock subassembly is secured to the lock body by a fastener accessible through a second shackle bore when the shackle is in the open position, wherein the lock subassembly is manipulable to be moved from the first position to the second position by loosening the fastener.

3. The padlock of claim 1, wherein the lock subassembly comprises a key cylinder lock.

4. The padlock of claim 3, wherein the key cylinder lock includes a cylinder retainer assembled with the key cylinder lock, wherein the cylinder retainer is secured to the lock body by a fastener.

5. The padlock of claim 1, wherein the lock subassembly is at least partially withdrawn from the lock body in the second position.

6. The padlock of claim 1, wherein a portion of the lock subassembly blocks extension of the shackle retaining pin into the cavity when the lock subassembly is in the first position.

7. The padlock of claim 1, further comprising a locking member that engages a notch in the first shackle leg when the lock subassembly is in the locked position, the locking member being disengageable from the notch when the lock subassembly is in the unlocked position.

8. The padlock of claim 7, wherein the recess is spaced apart from the notch around a circumference of the first shackle leg.

9. The padlock of claim 7, wherein the recess is spaced apart from the notch along a length of the first shackle leg.

10. The padlock of claim 1, wherein the shackle retaining pin is accessible from an external surface of the lock body.

11. A method of removing a shackle from a lock body of a padlock, the method comprising:

moving a shackle within a first shackle bore of the lock body to an open position;

with the shackle in the open position, moving a lock subassembly disposed in a cavity in the lock body from a first position to a second position to generate a space in the cavity in alignment with a shackle retaining pin having a first end portion at least partially disposed in the first shackle bore and within a recess in a first shackle leg disposed within the first shackle bore, and a second end portion extending into a cross-bore in the lock body, the cross-bore intersecting the first shackle bore and the cavity;

with the lock subassembly in the second position, moving the second end portion of the shackle retaining pin into the cavity space until the first end portion of the shackle retaining pin abuts a shoulder surface in the cross-bore, thereby disengaging the shackle retaining pin from the recess in the first shackle leg; and with the shackle retaining pin disengaged from the recess in the first shackle leg, withdrawing the first shackle leg from the first shackle bore to remove the shackle from the lock body.

12. The method of claim 11, wherein moving the lock subassembly from the first position to the second position comprises removing the lock subassembly from the lock body cavity.

13. The method of claim 11, wherein moving the shackle to an open position comprises withdrawing a short leg of the shackle from a second shackle bore in the lock body.

14. The method of claim 13, wherein moving the lock subassembly from the first position to the second position comprises loosening a fastener securing the lock subassembly within the lock body, the fastener being accessible through the second shackle bore.

15. The method of claim 13, wherein moving the shackle to the open position comprises operating the lock subassembly to move a blocker disposed within the lock body from a locked position, holding first and second locking members in locking engagement with first and second notches in the first and short shackle legs, to an unlocked position permitting disengagement of the first and second locking members from the first and second notches.

16. The method of claim 15, further comprising, after withdrawing the short shackle leg from the second shackle bore, inserting a tool in the second shackle bore to secure the blocker in the unlocked position when the shackle is removed from the lock body.

17. The method of claim 11, wherein moving the second end portion of the shackle retaining pin into the cavity space comprises accessing the shackle retaining pin through an external opening in the lock body.

18. A method of assembling a padlock, the method comprising:

providing a lock body defining first and second shackle bores, an internal cavity, and a cross-bore intersecting the first shackle bore and the cavity;

providing a shackle retaining pin in a shackle releasing position having a first end portion at least partially disposed in the cross-bore intersecting the first shackle bore and the cavity and a second end portion extending into the cavity, with the first end portion abutting a shoulder surface in the cross-bore;

with the shackle retaining pin in the shackle releasing position, inserting a long leg of a shackle into the first shackle bore to align a first end of a recess in the long shackle leg with the cross-bore;

with the long leg of the shackle inserted in the first shackle bore, moving the shackle retaining pin into a shackle retaining position such that the second end portion is withdrawn from the cavity into the cross-bore and the first end portion is received within the long shackle leg recess;

with the retaining pin in the shackle retaining position, inserting a lock subassembly into the cavity; and with the lock subassembly inserted into the cavity, securing the lock subassembly to the lock body.

19. The method of claim 18, further comprising positioning a blocker within the cavity in an unlocked position configured to permit withdrawal of first and second locking members from the first and second shackle bores, the blocker being movable to a locked position configured to hold the first and second locking members in the first and second shackle bores.

20. The method of claim 19, further comprising, prior to inserting the long shackle leg into the first shackle bore, inserting a tool into the second shackle bore to prevent movement of the second locking member into the second shackle bore, thereby securing the blocker in the unlocked position.

21. The method of claim 18, wherein securing the lock subassembly to the lock body comprises installing a fastener in a mounting hole disposed within the one of the first and second shackle bores and into threaded engagement with the lock subassembly.

* * * * *